US009655494B2

(12) United States Patent
Haft et al.

(10) Patent No.: US 9,655,494 B2
(45) Date of Patent: May 23, 2017

(54) DISHWASHER FILTRATION SYSTEM

(71) Applicant: Wolf Appliance, Inc., Fitchburg, WI (US)

(72) Inventors: Thomas Haft, Madison, WI (US); Gerry Lippincott, Milton, WI (US); Colin R. Clerkin, Waunakee, WI (US); Brian Wylie, Stoughton, WI (US)

(73) Assignee: Wolf Appliance, Inc., Fitchburg, WI (US)

( * ) Notice: Subject to any disclaimer, the term of this patent is extended or adjusted under 35 U.S.C. 154(b) by 240 days.

(21) Appl. No.: 14/296,746

(22) Filed: Jun. 5, 2014

(65) Prior Publication Data

US 2015/0352472 A1 Dec. 10, 2015

(51) Int. Cl.

| | |
|---|---|
| ***A47L 15/42*** | (2006.01) |
| *D06F 39/08* | (2006.01) |
| *A47L 15/23* | (2006.01) |

(52) U.S. Cl.

CPC ..... *A47L 15/4206* (2013.01); *A47L 15/23* (2013.01); *A47L 15/4202* (2013.01); *A47L 15/4204* (2013.01); *A47L 15/4221* (2013.01); *D06F 39/083* (2013.01)

(58) Field of Classification Search

CPC ..... A47L 15/4202; A47L 15/4206; A47L 15/4204

USPC ..... 134/110, 57 D

See application file for complete search history.

(56) References Cited

U.S. PATENT DOCUMENTS

| | | | | |
|---|---|---|---|---|
| 2,380,090 | A | 7/1945 | Wallace | |
| 2,905,393 | A | 9/1959 | Federighi et al. | |
| 3,035,706 | A | 5/1962 | Burke | |
| D197,026 | S | 12/1963 | Jellies et al. | |
| 4,972,861 | A * | 11/1990 | Milocco | A47L 15/4204 134/104.1 |
| 5,700,329 | A * | 12/1997 | Edwards | A47L 15/4204 134/10 |
| D461,284 | S | 8/2002 | Hegeman | |
| RE37,831 | E | 9/2002 | Thies | |
| D718,007 | S | 11/2014 | Baldwin et al. | |
| D720,509 | S | 12/2014 | Baldwin et al. | |
| D748,352 | S | 1/2016 | Baldwin et al. | |
| 2004/0163680 | A1 | 8/2004 | Elick et al. | |
| 2006/0005863 | A1 | 1/2006 | Gurubatham et al. | |
| 2006/0060228 | A1 | 3/2006 | Yoon et al. | |
| 2008/0072934 | A1 | 3/2008 | Pyo et al. | |
| 2008/0149148 | A1 | 6/2008 | Woo et al. | |

(Continued)

*Primary Examiner* — Joseph L Perrin
*Assistant Examiner* — Kevin G Lee
(74) *Attorney, Agent, or Firm* — Bell & Manning, LLC

(57) ABSTRACT

A liquid filtration system includes a sump screen, a filter, and a cap. The sump screen mounts to a tub bottom wall and includes a plate and a filter aperture edge mounted through the plate. The plate includes a sump mesh having a sump mesh size of less than approximately 0.1 inches. The filter mounts to the filter aperture edge and includes a sidewall and a plurality of posts mounted to extend up from the sidewall. The sidewall includes a filter mesh having a filter mesh size of less than approximately 0.1 inches. At least a portion of each post extends above the filter aperture edge when the filter is mounted to the filter aperture edge. The cap mounts above the plurality of posts. The plurality of posts and the cap form a conduit sized to allow material that cannot pass through the sump mesh to flow through the conduit.

30 Claims, 17 Drawing Sheets

(56) References Cited

U.S. PATENT DOCUMENTS

| | | | | |
|---|---|---|---|---|
| 2010/0006125 | A1 | 1/2010 | Kim | |
| 2010/0012160 | A1 | 1/2010 | Jeong et al. | |
| 2011/0226289 | A1 | 9/2011 | Förster | |
| 2012/0186609 | A1 | 7/2012 | Haltmayer et al. | |
| 2013/0056029 | A1* | 3/2013 | Boyer | A47L 15/4202 134/10 |
| 2013/0220386 | A1 | 8/2013 | Jozwiak | |
| 2014/0158168 | A1* | 6/2014 | Thiyagarajan | A47L 15/4206 134/104.2 |
| 2015/0000714 | A1* | 1/2015 | Yoo | A47L 15/22 134/111 |

* cited by examiner

DISHWASHER FILTRATION SYSTEM

BACKGROUND

Appliances such as dishwashers and clothes washers are provided with an interior wash chamber or tub. Dishwashers may further be provided with one or more racks, or baskets, that are designed to hold dishware within the interior of the tub during operation of the dishwasher. To effectively clean the dishware, one or more spray assemblies are typically provided. Each spray assembly typically includes a rotating spray arm that is fluidly connected to a pump though one or more conduits. The pump supplies fluid to the spray arm, which in turn sprays dishwashing fluid and/or water onto the dishware.

Many dishwashers today use some method of filtering the water distributed to the spray arms. The filtration system may include a sump screen and/or a removable filter. Typically, the water flowing from the dishware flows around the spray arm as well as other components in the bottom of the tub. These obstacles to water flow provide areas where soil and debris can accumulate resulting in a redeposit of soils on the dishware during the wash cycle and/or a buildup of debris to be cleaned out by a consumer.

SUMMARY

In an example embodiment, a liquid filtration system is provided. The liquid filtration system may include, but is not limited to, a sump screen, a filter, and a cap. The sump screen mounts to a tub bottom wall and includes, but is not limited to, a plate and a filter aperture edge mounted through the plate. The plate includes, but is not limited to, a sump mesh having a sump mesh size of less than approximately 0.1 inches. The filter mounts to the filter aperture edge and includes, but is not limited to, a sidewall and a plurality of posts mounted to extend up from the sidewall. The sidewall includes, but is not limited to, a filter mesh having a filter mesh size of less than approximately 0.1 inches. At least a portion of each post extends above the filter aperture edge when the filter is mounted to the filter aperture edge. The cap mounts above the plurality of posts. The plurality of posts and the cap form a conduit sized to allow material that cannot pass through the sump mesh to flow through the conduit.

In another example embodiment, a liquid processing system is provided. The liquid processing system may include, but is not limited to, a center post conduit configured to mount to a liquid source, a spray arm configured to mount to the center post conduit and configured to receive liquid from the center post conduit, and a liquid filtration system. The spray arm includes, but is not limited to, a hole through which the liquid received from the center post conduit is sprayed. The liquid filtration system may include, but is not limited to, a sump screen, a filter, and a cap. The sump screen mounts to a tub bottom wall and includes, but is not limited to, a plate and a filter aperture edge mounted through the plate. The plate includes, but is not limited to, a sump mesh having a sump mesh size of less than approximately 0.1 inches. The filter mounts to the filter aperture edge and includes, but is not limited to, a sidewall and a plurality of posts mounted to extend up from a top edge of the sidewall, wherein the top edge of the sidewall forms a top aperture edge and a bottom edge of the sidewall forms a bottom aperture edge opposite the top aperture edge. The sidewall includes, but is not limited to, a filter mesh having a filter mesh size of less than approximately 0.1 inches. At least a portion of each post extends above the filter aperture edge when the filter is mounted to the filter aperture edge. The cap mounts above the plurality of posts. The plurality of posts and the cap form a conduit sized to allow material that cannot pass through the sump mesh to flow through the conduit. The center post conduit extends through the bottom aperture edge, the top aperture edge, and the cap. The spray arm is configured to mount above the cap on a side opposite the plurality of posts.

In yet another example embodiment, a washer is provided. The washer may include, but is not limited to, a body, a tub bottom wall mounted within the body, a door, a hinge pivotally mounting the door to the body, a fluid supply system mounted to the body, a spray arm, and a liquid processing system. The fluid supply system includes, but is not limited to, a wash pump, a first conduit mounted to the wash pump to receive liquid from the wash pump, a second conduit mounted to the wash pump to receive liquid from a wash pump input nozzle of a sump, and a center post conduit configured to mount to the first conduit. The spray arm mounts to the center post conduit to receive liquid from the wash pump. The spray arm includes, but is not limited to, a hole through which the liquid received from the wash pump is sprayed. The liquid filtration system may include, but is not limited to, a sump screen, a filter, and a cap. The sump screen mounts to the tub bottom wall and includes, but is not limited to, a plate and a filter aperture edge mounted through the plate. The plate includes, but is not limited to, a sump mesh having a sump mesh size of less than approximately 0.1 inches. The filter mounts to the filter aperture edge and includes, but is not limited to, a sidewall and a plurality of posts mounted to extend up from a top edge of the sidewall, wherein the top edge of the sidewall forms a top aperture edge and a bottom edge of the sidewall forms a bottom aperture edge opposite the top aperture edge. The sidewall includes, but is not limited to, a filter mesh having a filter mesh size of less than approximately 0.1 inches. At least a portion of each post extends above the filter aperture edge when the filter is mounted to the filter aperture edge. The cap mounts above the plurality of posts. The plurality of posts and the cap form a conduit sized to allow material that cannot pass through the sump mesh to flow through the conduit. The center post conduit extends through the bottom aperture edge, the top aperture edge, and the cap. The spray arm is configured to mount above the cap on a side opposite the plurality of posts.

Other principal features and advantages will become apparent to those skilled in the art upon review of the following drawings, the detailed description, and the appended claims.

BRIEF DESCRIPTION OF THE DRAWINGS

Illustrative embodiments of the disclosed subject matter will hereafter be described with reference to the accompanying drawings, wherein like numerals denote like elements.

DETAILED DESCRIPTION

Figure 1:
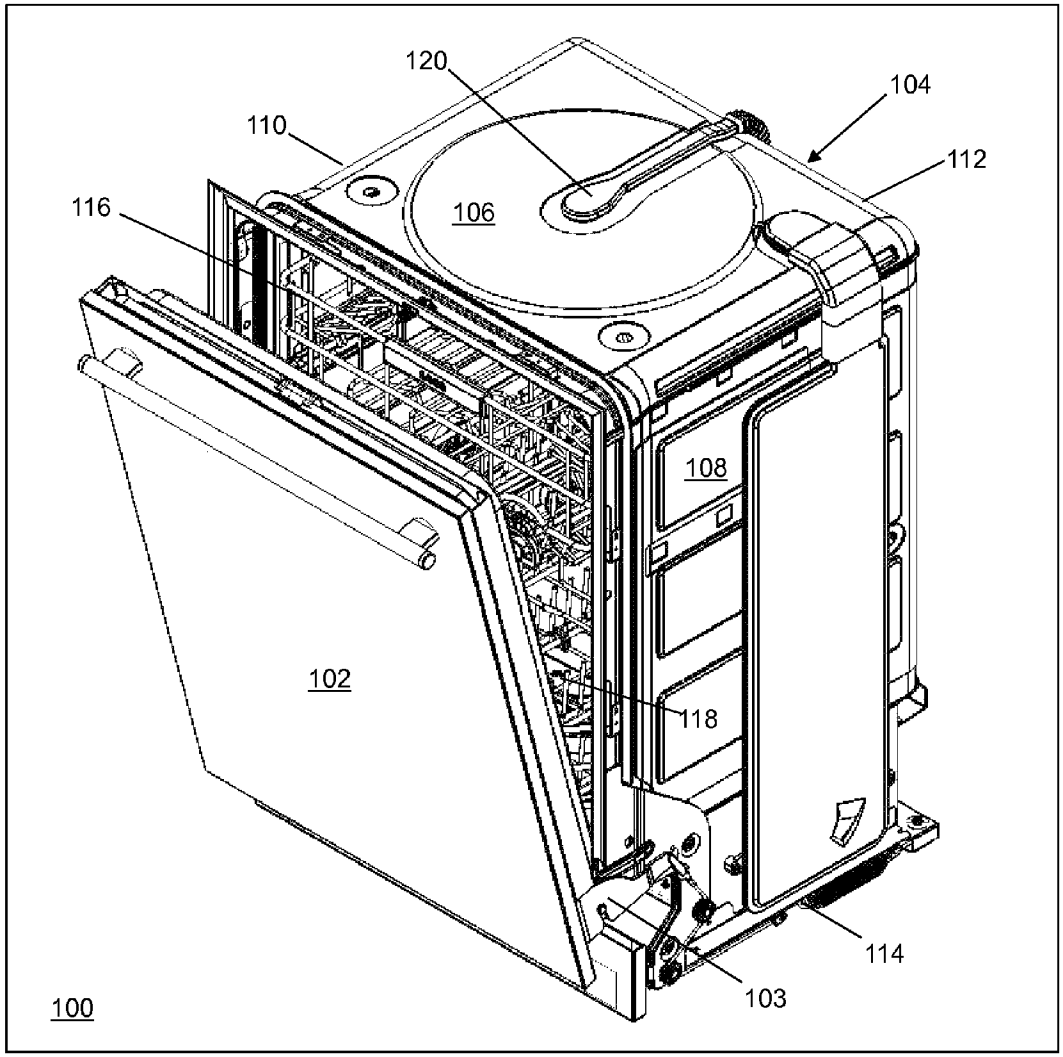
FIG. 1 depicts a front perspective view of a dishwasher in accordance with an illustrative embodiment.

With reference to FIG. 1, a dishwasher 100 is shown in accordance with an illustrative embodiment. Though described with reference to dishwasher 100, it should be understood that one or more of the components described herein may be applied in a clothes washer.

Dishwasher 100 may include a door 102 and a body 104. Door 102 rotates from a vertical position to a horizontal position as understood by a person of skill in the art. A plurality of hinges 103 pivotally mount door 102 to body 104 proximate a lower edge of door 102. Use of directional terms, such as top, bottom, right, left, front, back, upper, lower, etc. are merely intended to facilitate reference to the various surfaces of the described structures relative to the orientations shown in the drawings and are not intended to be limiting in any manner.

As used herein, the term "mount" includes join, unite, connect, couple, associate, insert, hang, hold, affix, attach, fasten, bind, paste, secure, bolt, screw, rivet, solder, weld, glue, form over, form in, layer, mold, rest on, rest against, abut, and other like terms. The phrases "mounted on", "mounted to", and equivalent phrases indicate any interior or exterior portion of the element referenced. These phrases also encompass direct mounting (in which the referenced elements are in direct contact) and indirect mounting (in which the referenced elements are not in direct contact, but are connected through an intermediate element). Elements referenced as mounted to each other herein may further be integrally formed together, for example, using a molding or thermoforming process as understood by a person of skill in the art. As a result, elements described herein as being mounted to each other need not be discrete structural elements. The elements may be mounted permanently, removably, or releasably unless specified otherwise.

Dishwasher 100 may include a greater or a fewer number of components than those illustrated. The one or more components of dishwasher 100 may be formed of one or more materials, such as various metals, glass, elastomeric material, and/or plastics having a sufficient strength and rigidity to support the described application.

In the illustrative embodiment, body 104 includes a plurality of walls that, in combination with door 102, form an enclosed space or wash tub. The plurality of walls of body 104 may include a top wall 106, a right side wall 108, a left side wall 110, a back wall 112, and a bottom wall 114. Top wall 106, right side wall 108, left side wall 110, back wall 112, and a tub bottom wall 202 (shown with reference to FIG. 2) define a wash tub. Bottom wall 114 may not cover the entire area between right side wall 108, left side wall 110, and back wall 112.

Door 102 rotates downward to provide access to the wash tub. The wash tub may include one or more baskets on which dishware or other items are placed for washing and/or rinsing. For example, dishwasher 100 includes a top dishware basket 116 and a bottom dishware basket 118. Of course, dishwasher 100 may include one or more additional baskets above and/or below top dishware basket 116 and/or bottom dishware basket 118. As understood by a person of skill in the art, top dishware basket 116 and bottom dishware basket 118 can be slid into and out of the wash tub using a variety of mounting methods. A height of top dishware basket 116 and bottom dishware basket 118 within body 104 and relative to tub bottom wall 202 may be adjustable as understood by a person of skill in the art.

The wash tub may include one or more spray arms that spray a washing fluid on the dishware loaded on the one or more baskets. For example, dishwasher 100 may include a lower spray arm 204, an upper spray arm (not shown), and a middle spray arm (not shown) mounted at different heights above tub bottom wall 202. A top spray arm conduit 120 may mount the upper spray arm to a wash pump 302 (shown with reference to FIG. 3). Lower spray arm 204 is mounted to extend up from tub bottom wall 202 and is configured to spray the washing fluid upward and/or downward as understood by a person of skill in the art. Dishwasher 100 may include a fewer or a greater number of spray arms.

Figure 2:
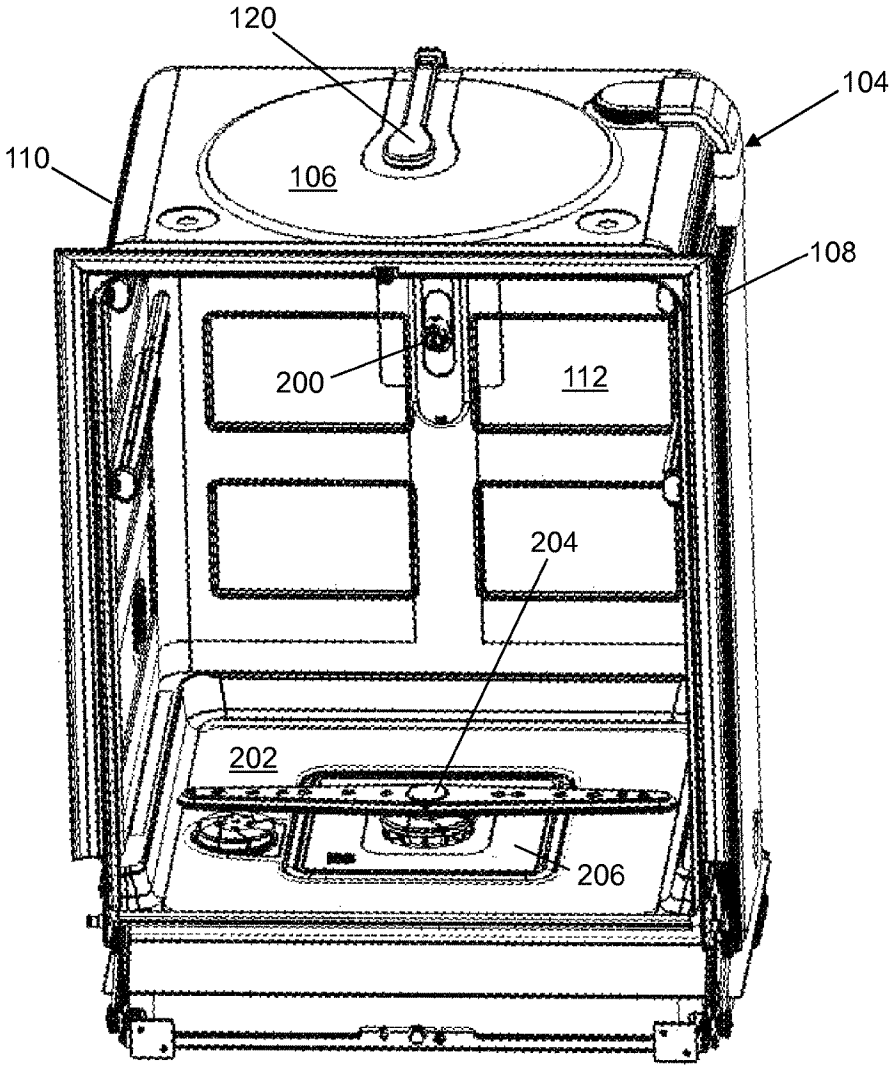
FIG. 2 depicts a front view of the dishwasher of FIG. 1 without a door or dishware baskets in accordance with an illustrative embodiment.

With reference to FIG. 2, a front view of dishwasher 100 is shown in accordance with an illustrative embodiment without door 102, top dishware basket 116, or bottom dishware basket 118. A middle spray arm nozzle 200 may mount the middle spray arm to wash pump 302. Tub bottom wall 202 mounts within body 104 between right side wall 108, left side wall 110, and back wall 112 and above bottom wall 114. A sump screen 206 mounts to tub bottom wall 202.

Figure 3:
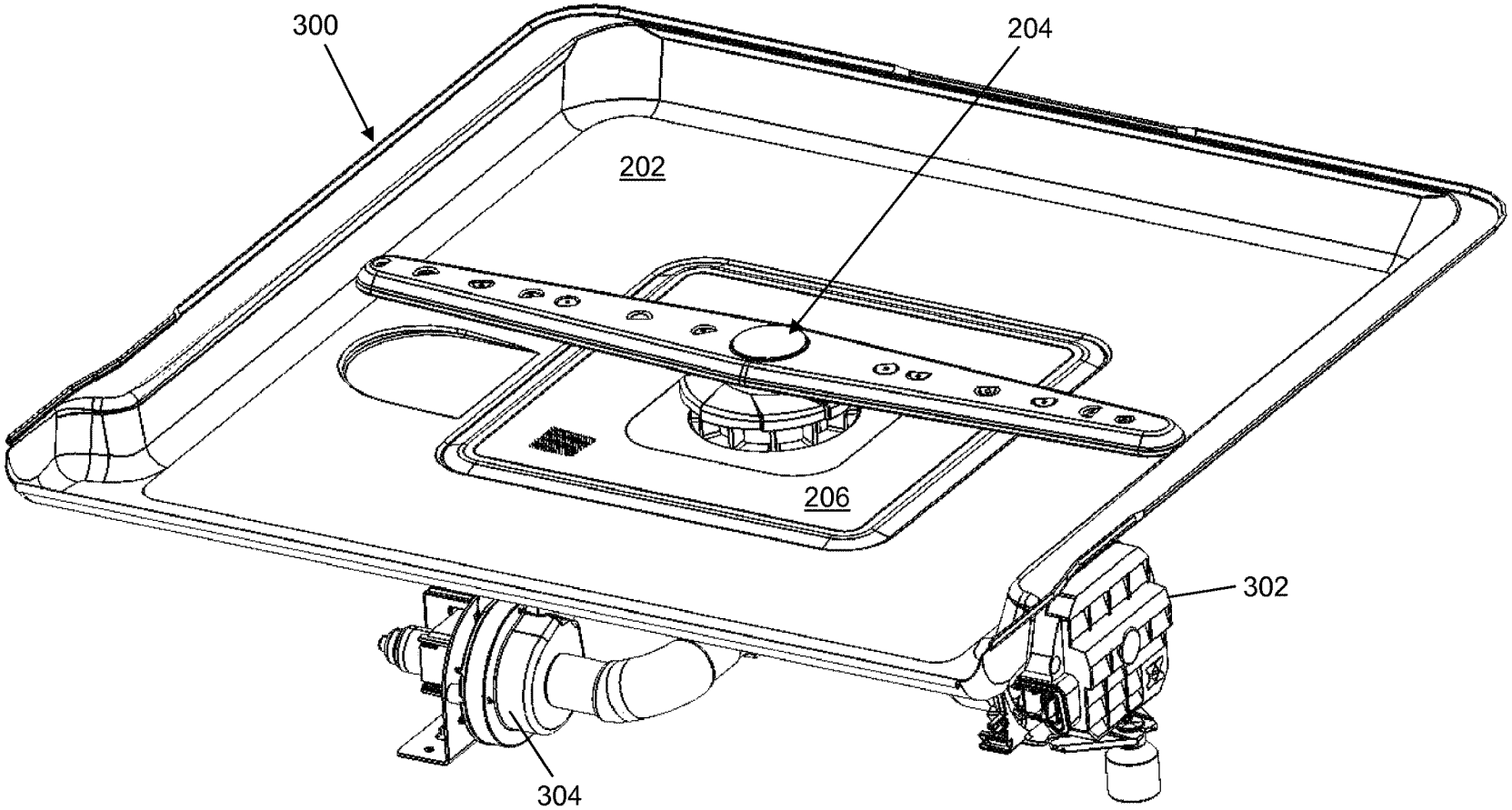
FIG. 3 depicts a front perspective view of a dishwasher basin of the dishwasher of FIG. 1 in accordance with an illustrative embodiment.

With reference to FIG. 3, a front perspective view of a dishwasher basin 300 of dishwasher 100 is shown in accordance with an illustrative embodiment. Dishwasher basin 300 may include tub bottom wall 202, lower spray arm 204, and sump screen 206. A wash pump 302 and a drain pump 304 mount via conduits to dishwasher basin 300.

Figure 4:
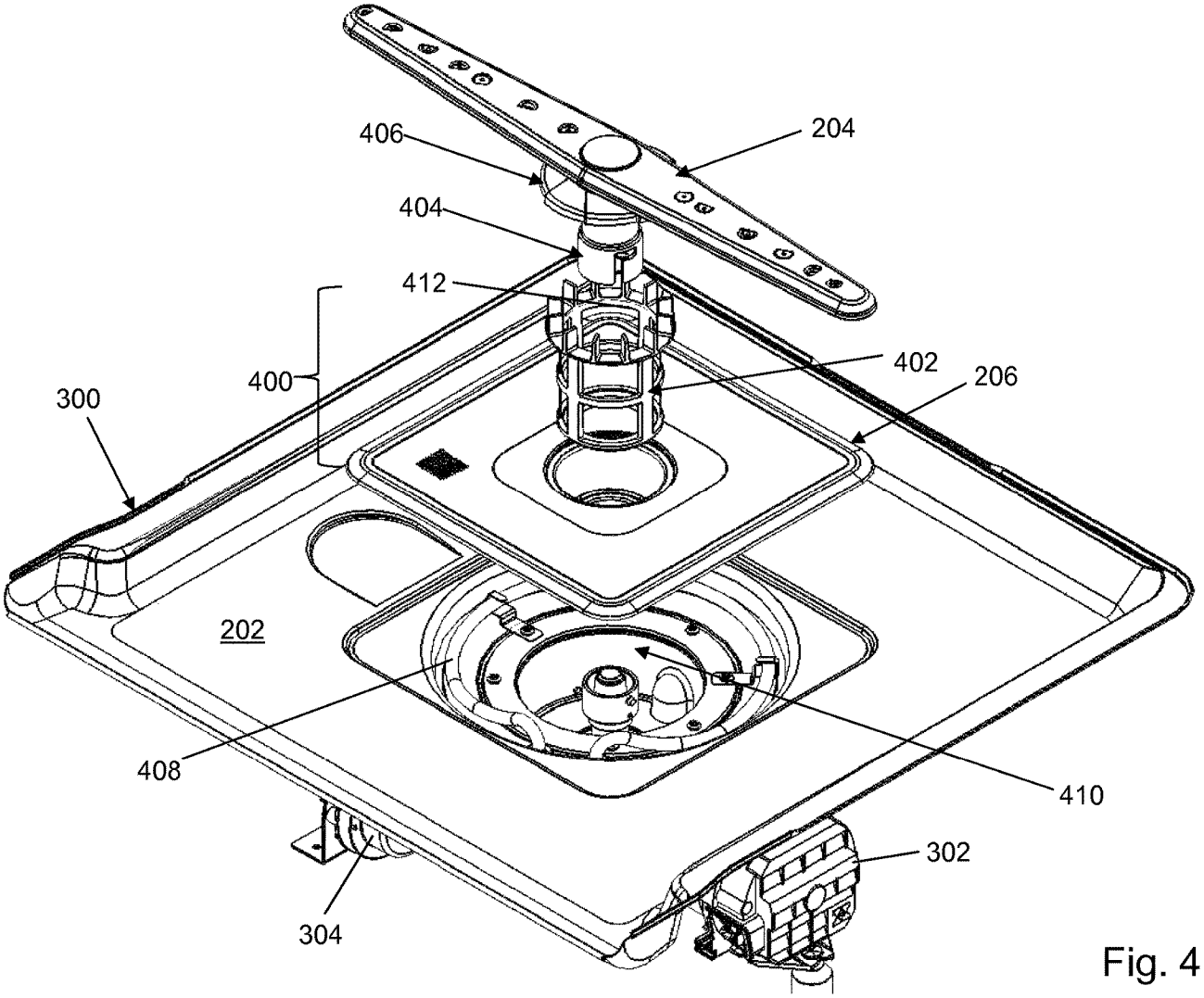
FIG. 4 depicts a front perspective view of the dishwasher basin of the dishwasher of FIG. 1 with a filtration system and a spray arm exploded in accordance with an illustrative embodiment.

With reference to FIG. 4, a front perspective view of dishwasher basin 300 of dishwasher 100 is shown in accordance with an illustrative embodiment with a filtration system 400 and lower spray arm 204 exploded. Dishwasher basin 300 further may include lower spray arm 204, filtration system 400, a spray arm coupler 404, a heating element 408, and a sump 410. Filtration system 400 may include sump screen 206, a filter 402, and a cap 406. Spray arm coupler 404 mounts to lower spray arm 204. Wash pump 302 and drain pump 304 mount via conduits to sump 410 of dishwasher basin 300.

Figure 5:
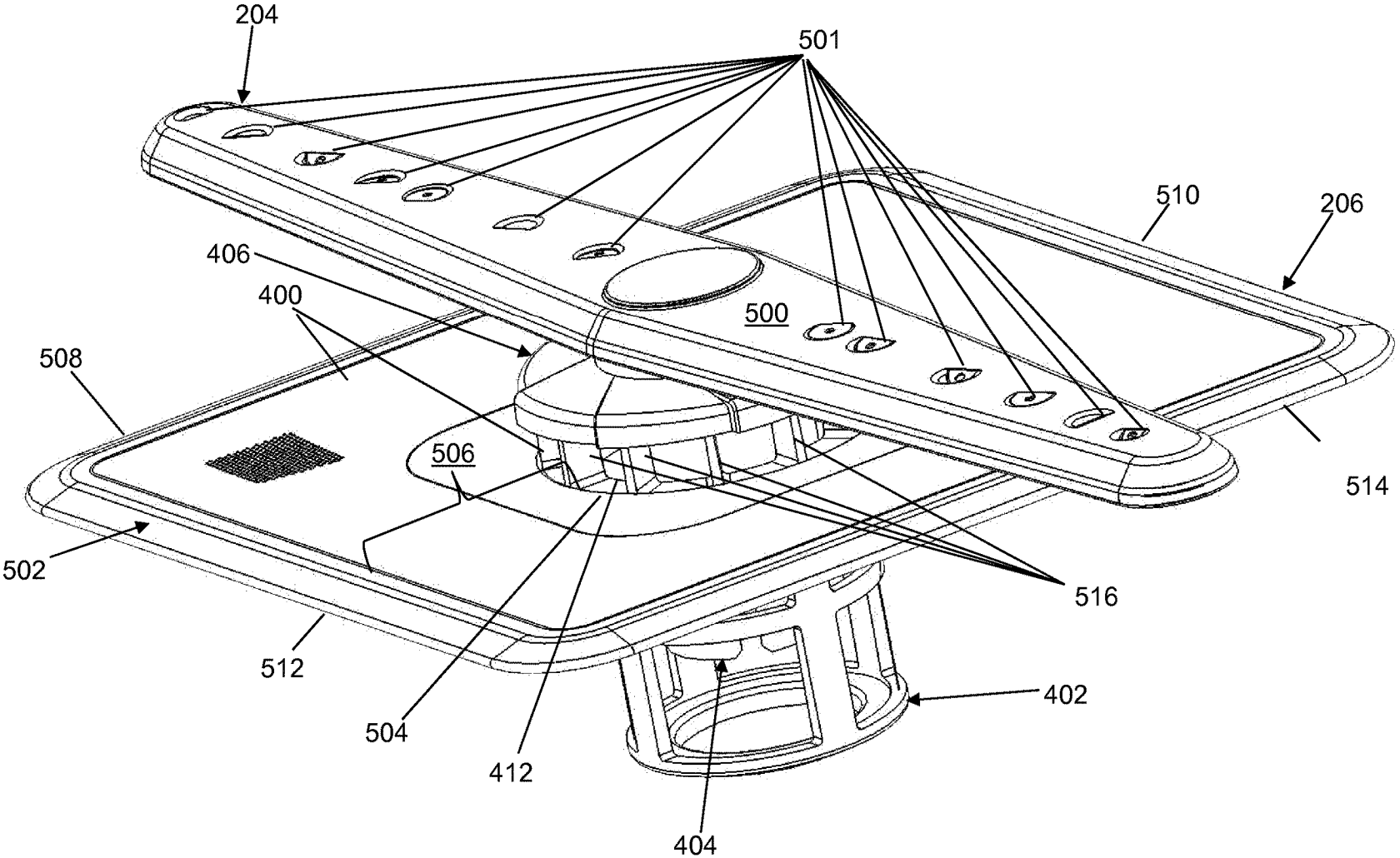
FIG. 5 depicts a perspective view of the filtration system and the spray arm of FIG. 4 in accordance with an illustrative embodiment.

With reference to FIG. 5, a perspective view of filtration system 400 and lower spray arm 204 is shown in accordance with an illustrative embodiment. Lower spray arm 204 may include an upper plate 500 and a plurality of spray nozzles 501 through which liquid, such as water and/or washing fluid received from wash pump 302, is sprayed. A greater or a fewer number of spray nozzles 501 may be included in upper plate 500. Each spray nozzle of the plurality of spray nozzles 501 may be configured to spray the liquid in the same and/or a different direction. Lower spray arm 204 is further mounted to rotate as understood by a person of skill in the art.

Sump screen 206 may include an outer rim 502 and an inner rim 504, and a plate 506 mounted between outer rim 502 and inner rim 504. Outer rim 502 may include a left edge 508, a back edge 510, a front edge 512, and a right edge 514. In the illustrative embodiment, outer rim 502 has a square shape when viewed from above. Outer rim 502 may have alternative shapes such as circular and elliptical as well as other polygonal shapes. At least a portion of plate 506 comprises a sump mesh (not shown). In an illustrative embodiment, approximately all of plate 506 comprises the sump mesh. For illustration, the sump mesh has a sump mesh size of less than approximately 0.03 inches meaning that material having dimensions greater than approximately 0.03 inches cannot flow through the portion of plate 506 that comprises the sump mesh. Of course, other sump mesh sizes may be selected based on conduit sizes and/or pumps through which the material passing through the mesh flows. As another example, the sump mesh size may be less than approximately 0.35 inches or less than approximately 0.1 inches.

In the illustrative embodiment, inner rim 504 has a circular shape when viewed from above. Inner rim 504 may have alternative shapes such as elliptical or polygonal. The sump mesh is sized such that a vast majority of debris flows over plate 506 and past inner rim 504. Filter 402 may include a plurality of posts 516 that extend above plate 506.

Figure 6:
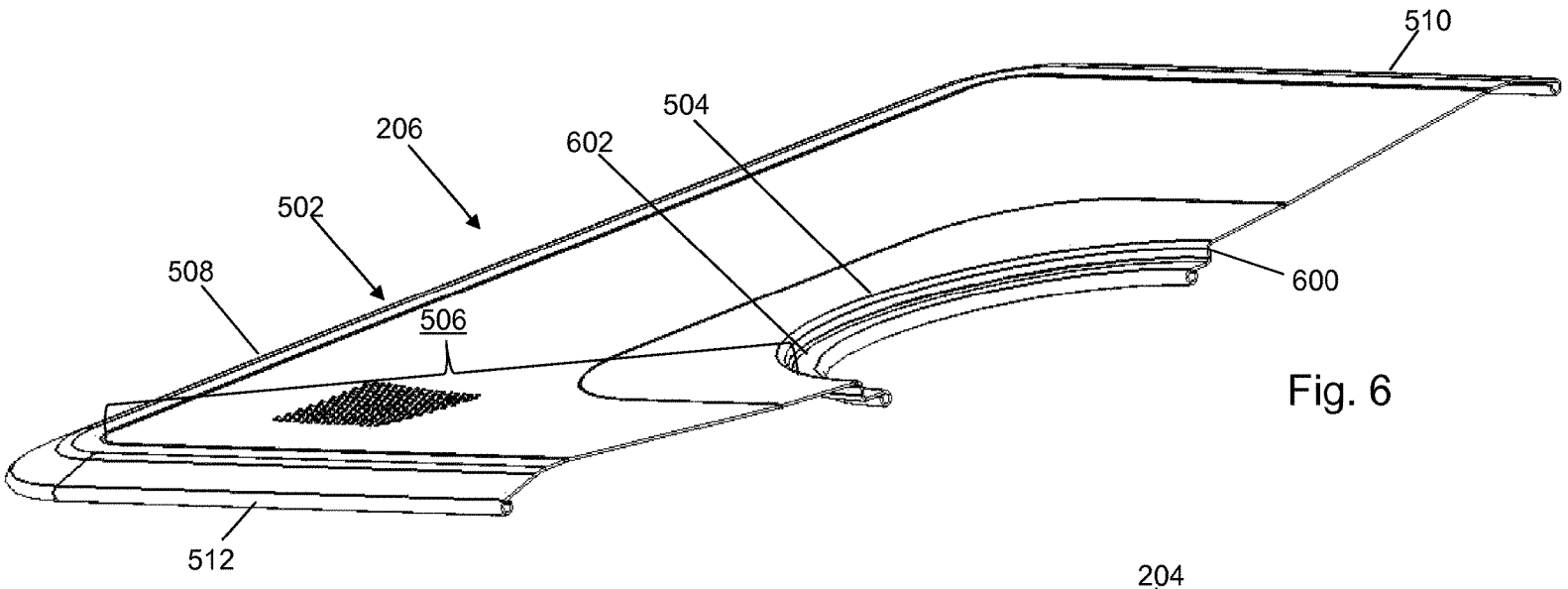
FIG. 6 depicts a left side elevation view of a sump screen of the filtration system of FIG. 4 in accordance with an illustrative embodiment.

With reference to FIG. 6, a left side elevation view of sump screen 206 is shown in accordance with an illustrative embodiment. Sump screen 206 further may include a rim wall 600 and a ledge 602. Rim wall 600 extends downward from inner rim 504. Ledge 602 extends toward a center of plate 506 away from rim wall 600. Ledge 602 forms a filter aperture edge that surrounds an opening mounted through a center of plate 506. Plate 506 may slope downward toward inner rim 504.

Figure 7:
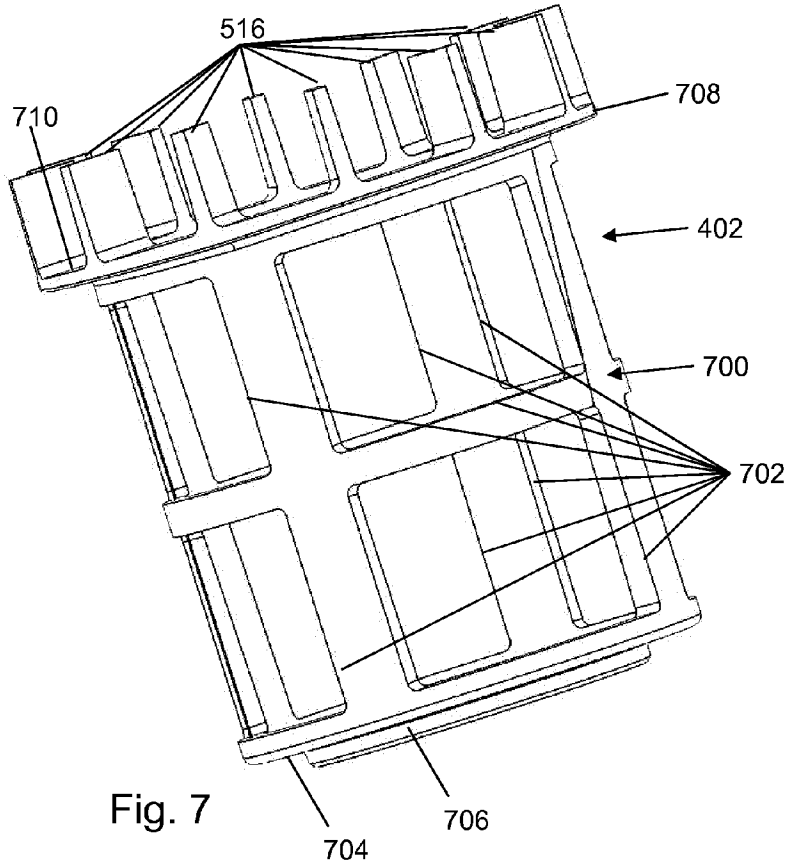
FIG. 7 depicts a perspective view of a filter of the filtration system of FIG. 4 in accordance with an illustrative embodiment.

With reference to FIG. 7, a perspective view of filter 402 is shown in accordance with an illustrative embodiment. Filter 402 may include a filter sidewall 700, a plurality of window aperture edges 702, a filter bottom wall 704, a filter flange 706, a shelf 708, a top shelf surface 710, and the plurality of posts 516. Filter sidewall 700 extends between filter bottom wall 704 and shelf 708. The plurality of window aperture edges 702 form window openings in filter sidewall 700. In the illustrative embodiment, the window openings formed by the aperture edges 702 have a rectangular shape though other shapes may be used. In alternative embodiments, a fewer or a greater number of window openings may be formed by the plurality of window aperture edges 702. For illustration, a filter mesh having a filter mesh size of less than approximately 0.008 inches extends across each of the plurality of window aperture edges 702 to cover each window opening meaning that material having dimensions greater than approximately 0.008 inches cannot flow through the portion of filter sidewall 700 that comprises the filter mesh. In an alternative embodiment, filter sidewall 700 may be formed entirely or essentially entirely of the filter mesh. The filter mesh size may be less than, equal to, or greater than the sump mesh size. Other filter mesh sizes may be selected based on conduit sizes through which the material passing through the mesh flows.

Filter bottom wall 704 extends away from filter sidewall 700 toward an interior of filter 402 forming a bottom edge of filter sidewall 700. Filter flange 706 extends downward from filter bottom wall 704. Filter flange 706 forms a bottom aperture edge that surrounds an opening mounted through filter bottom wall 704. In an illustrative embodiment, the filter mesh is mounted across the opening defined by the bottom aperture edge. In an alternative embodiment, the filter mesh is not mounted across the opening defined by the bottom aperture edge.

Shelf 708 extends away from filter sidewall 700 toward an exterior of filter 402 forming a top edge of filter sidewall 700. The plurality of posts 516 are mounted to extend up from top shelf surface 710 of shelf 708. Shelf 708 includes a top aperture edge 412 (shown with reference to FIGS. 4 and 5) that defines an opening into the interior of filter 402.

Figure 8:
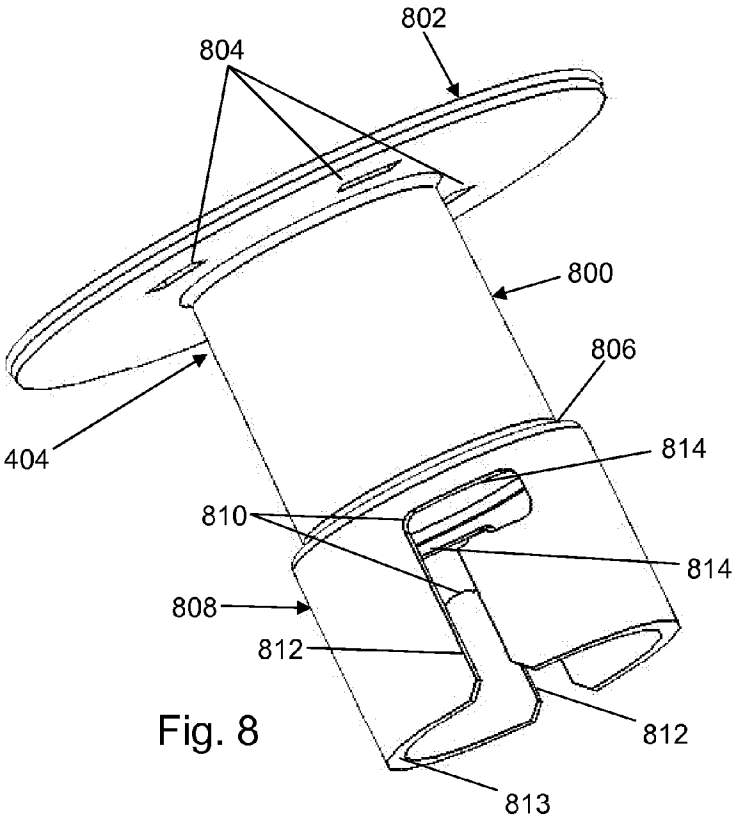
FIG. 8 depicts a perspective view of a spray arm coupler of the filtration system of FIG. 4 in accordance with an illustrative embodiment.

Referring to FIG. 8, a perspective view of spray arm coupler 404 is shown in accordance with an illustrative embodiment. Spray arm coupler 404 may include a coupler sidewall 800, a coupler top plate 802, a plurality of tab aperture edges 804, a coupler rib 806, a coupler transition wall 808, and coupling aperture edges 810. Coupler sidewall 800 extends between coupler top plate 802 and coupler rib 806. Coupler top plate 802 extends away from coupler sidewall 800 toward an exterior of spray arm coupler 404 forming a top edge of coupler sidewall 800. The plurality of tab aperture edges 804 define openings through coupler top plate 802.

Coupler rib 806 extends downward and away from coupler sidewall 800 toward an exterior of spray arm coupler 404. Coupler rib 806 is a transition between coupler sidewall 800 and coupler transition wall 808. Coupler top plate 802, coupler sidewall 800, and coupler transition wall 808 define an open cylinder. An internal radius of the open cylinder within coupler transition wall 808 may be greater than an internal radius of the open cylinder within coupler sidewall 800 though this is optional. Coupler sidewall 800 and coupler transition wall 808 are sized and shaped to fit within the opening into the interior of filter 402 formed by shelf 708 and within the opening mounted through filter bottom wall 704.

Coupling aperture edges 810 are mounted through coupler transition wall 808. In the illustrative embodiment, spray arm coupler 404 includes two coupling aperture edges 810. In an alternative embodiment, a greater or a fewer number of coupling aperture edges 810 may be mounted through coupler transition wall 808. In the illustrative embodiment, each coupling aperture edge forms a vertical channel 812 that extends up from a coupler bottom aperture edge 813 and a horizontal channel 814 that extends from vertical channel 812.

In an alternative embodiment, spray arm coupler 404 may not include coupler rib 806 or coupler transition wall 808. Coupling aperture edges 810 instead may be mounted through coupler sidewall 800.

Referring again to FIG. 5, at least a portion of each post of the plurality of posts 516 extends above inner rim 504 when filter 402 is mounted to sump screen 206 by positioning shelf 708 on ledge 602. Ledge 602 is sized and shaped large enough to support shelf 708. Filter sidewall 700 is sized and shaped to fit within the filter aperture edge that surrounds the opening mounted through the center of sump screen 206. Cap 406 and coupler top plate 802 mount above the plurality of posts 516. The plurality of posts 516, top shelf surface 710, and coupler top plate 802 form a plurality of conduits. The plurality of conduits may be sized to allow material having various dimensions to pass into the interior of filter 402 while blocking larger material. For example, filter mesh mounted across the opening defined by the bottom aperture edge may accommodate larger sized material because the material does not enter the drain system. For illustration, the plurality of conduits may be sized to allow material having a dimension less than approximately 0.5 to one inch to pass into the interior of filter 402 while material having a dimension greater than approximately 0.5 to one inch cannot pass into the interior of filter 402. As another example, a spacing between adjacent posts of the plurality of posts 516 may be selected to block particles having a dimension large enough to clog a drain system when filter mesh is not mounted across the opening defined by the bottom aperture edge. A height of each post of the plurality of posts 516 may further be selected to block particles having a dimension that could clog the drain system. Depending on the drain system, in this example embodiment, the plurality of conduits may be sized to allow material having a dimension less than approximately 0.25 to 0.5 inches to pass into the interior of filter 402 while material having a dimension greater than approximately 0.25 to 0.5 inches cannot pass into the interior of filter 402.

Figure 10:
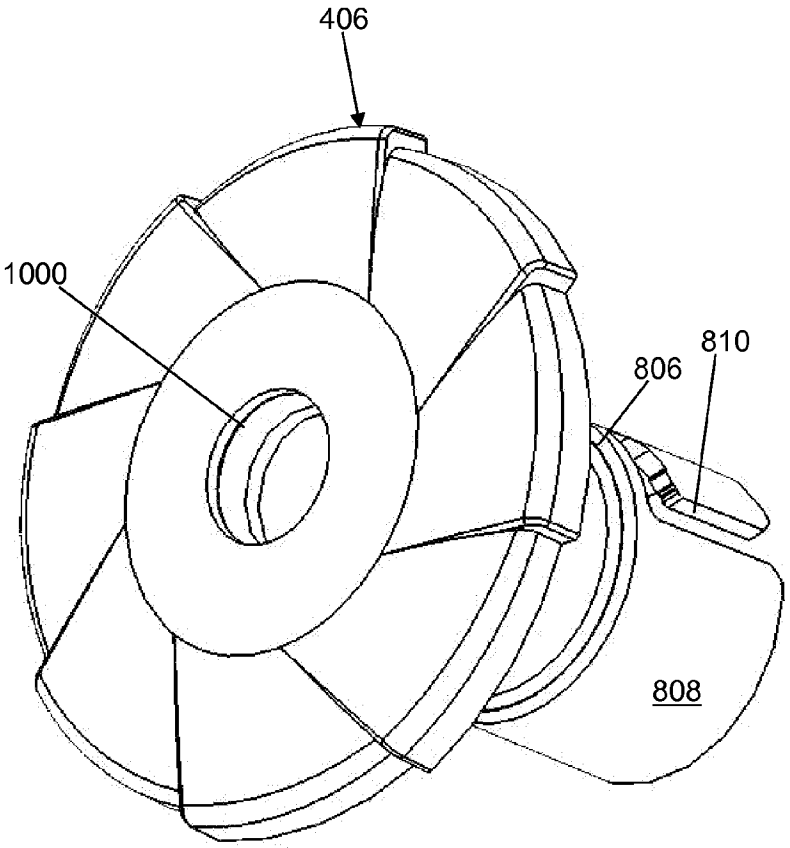
FIG. 10 depicts a top perspective view of the spray arm coupler and the cap of the filtration system of FIG. 9 in accordance with an illustrative embodiment.
Figure 9:
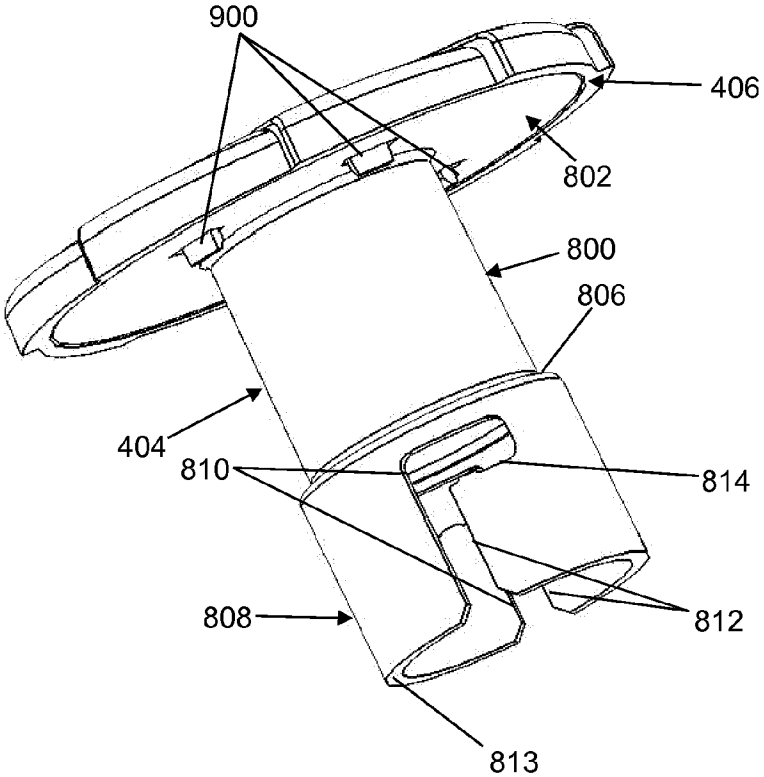
FIG. 9 depicts a side perspective view of the spray arm coupler and a cap of the filtration system of FIG. 4 in accordance with an illustrative embodiment.

Referring to FIG. 9, a side perspective view of spray arm coupler 404 and cap 406 is shown in accordance with an illustrative embodiment. Referring to FIG. 10, a top perspective view of spray arm coupler 404 and cap 406 is shown in accordance with an illustrative embodiment. Cap 406 includes cap tabs 900 and a center post aperture edge 1000. Spray arm coupler 404 mounts to cap 406 on a side opposite lower spray arm 204 by inserting cap tabs 900 through corresponding openings defined by the plurality of tab aperture edges 804.

Figure 11:
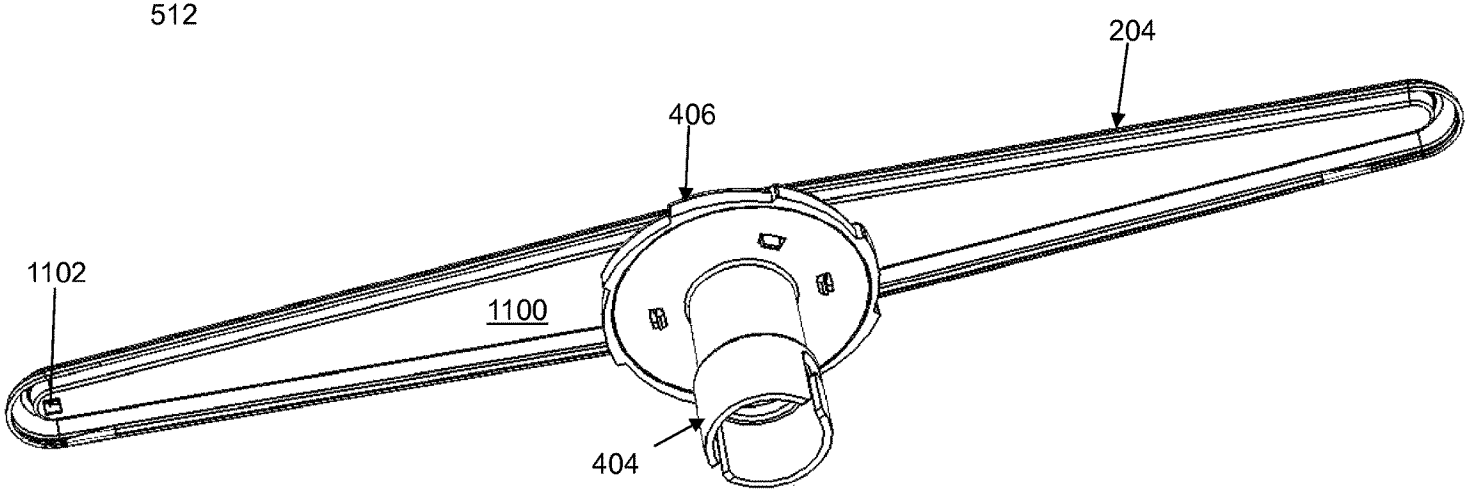
FIG. 11 depicts a bottom perspective view of the spray arm and the spray arm coupler and the cap of the filtration system of FIG. 4 in accordance with an illustrative embodiment.

Referring to FIG. 11, a bottom perspective view of lower spray arm 204, spray arm coupler 404, and cap 406 is shown in accordance with an illustrative embodiment. Lower spray arm 204 further includes a lower plate 1100 and a lower spray nozzle 1102. Liquid, such as water and/or washing fluid received from wash pump 302, is sprayed through lower spray nozzle 1102 mounted through lower plate 1100. A greater number of lower spray nozzles may be included in lower plate 1100. In an illustrative embodiment, lower spray nozzle 1102 is configured to spray the liquid downward and towards filter 402 when lower spray arm 204 and filter 402 are mounted to tub bottom wall 202.

Figure 12:
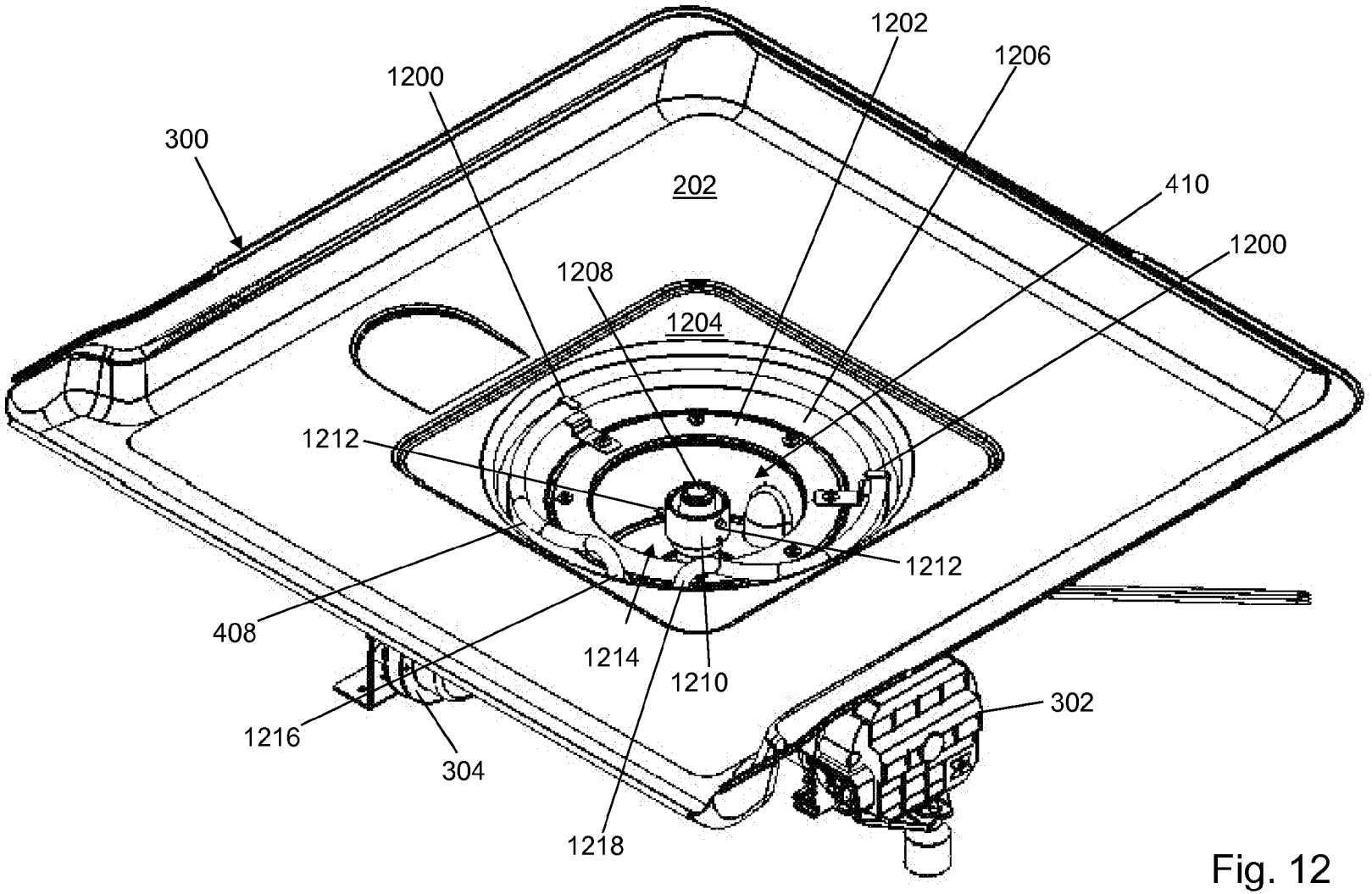
FIG. 12 depicts a front perspective view of the dishwasher basin of the dishwasher of FIG. 1 without the filtration system and the spray arm in accordance with an illustrative embodiment.

Referring to FIG. 12, a front perspective view of dishwasher basin 300 without filtration system 400, lower spray arm 204, spray arm coupler 404, and cap 406 is shown in accordance with an illustrative embodiment. A plurality of brackets 1200 mount heating element 408 to sump rim 1202. In the illustrative embodiment, the plurality of brackets 1200 include two brackets. A greater or a fewer number of the plurality of brackets 1200 may be used.

Figure 13:
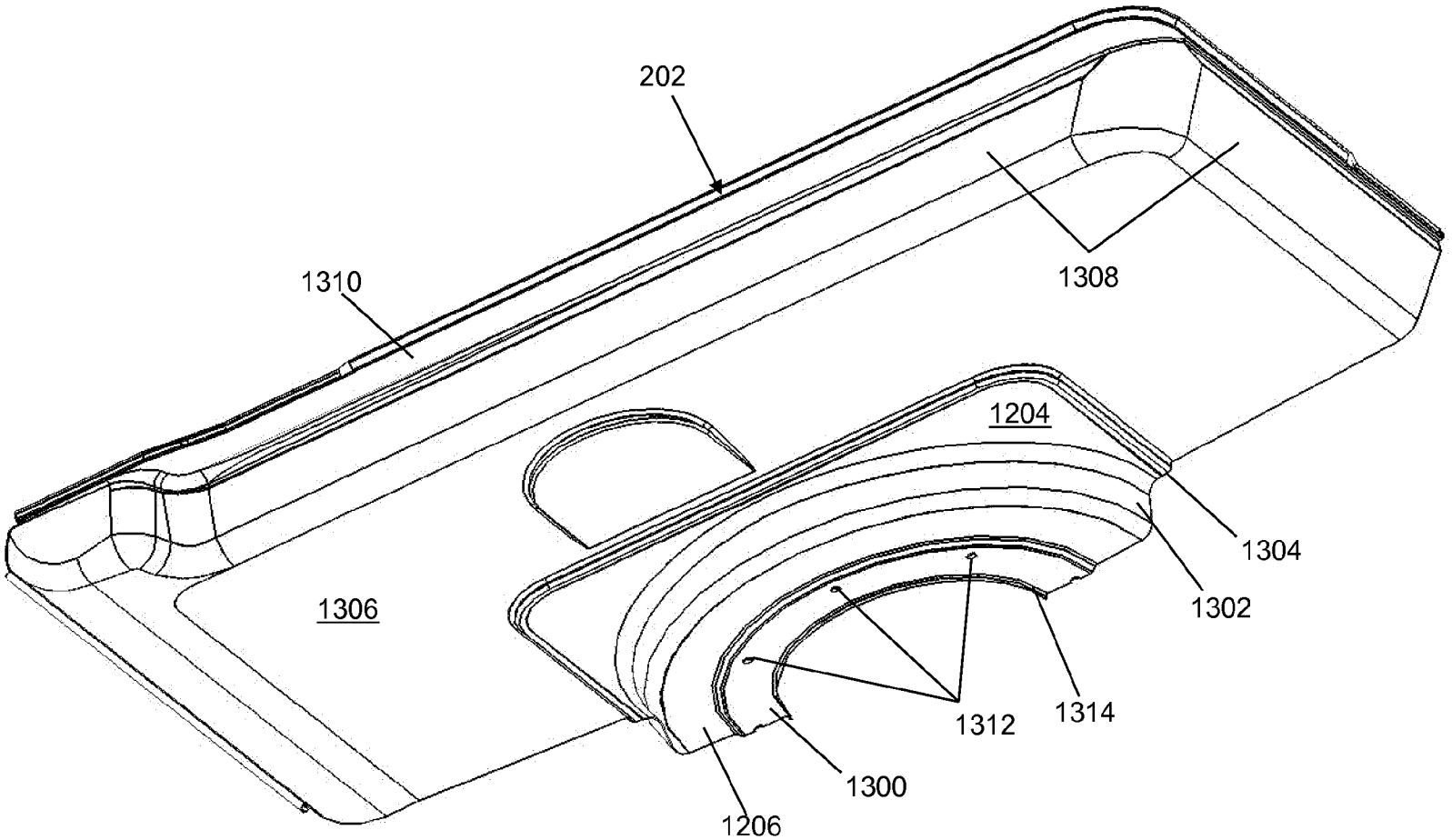
FIG. 13 depicts a right side elevation view of a tub bottom wall of the dishwasher of FIG. 1 in accordance with an illustrative embodiment.
Figure 14:
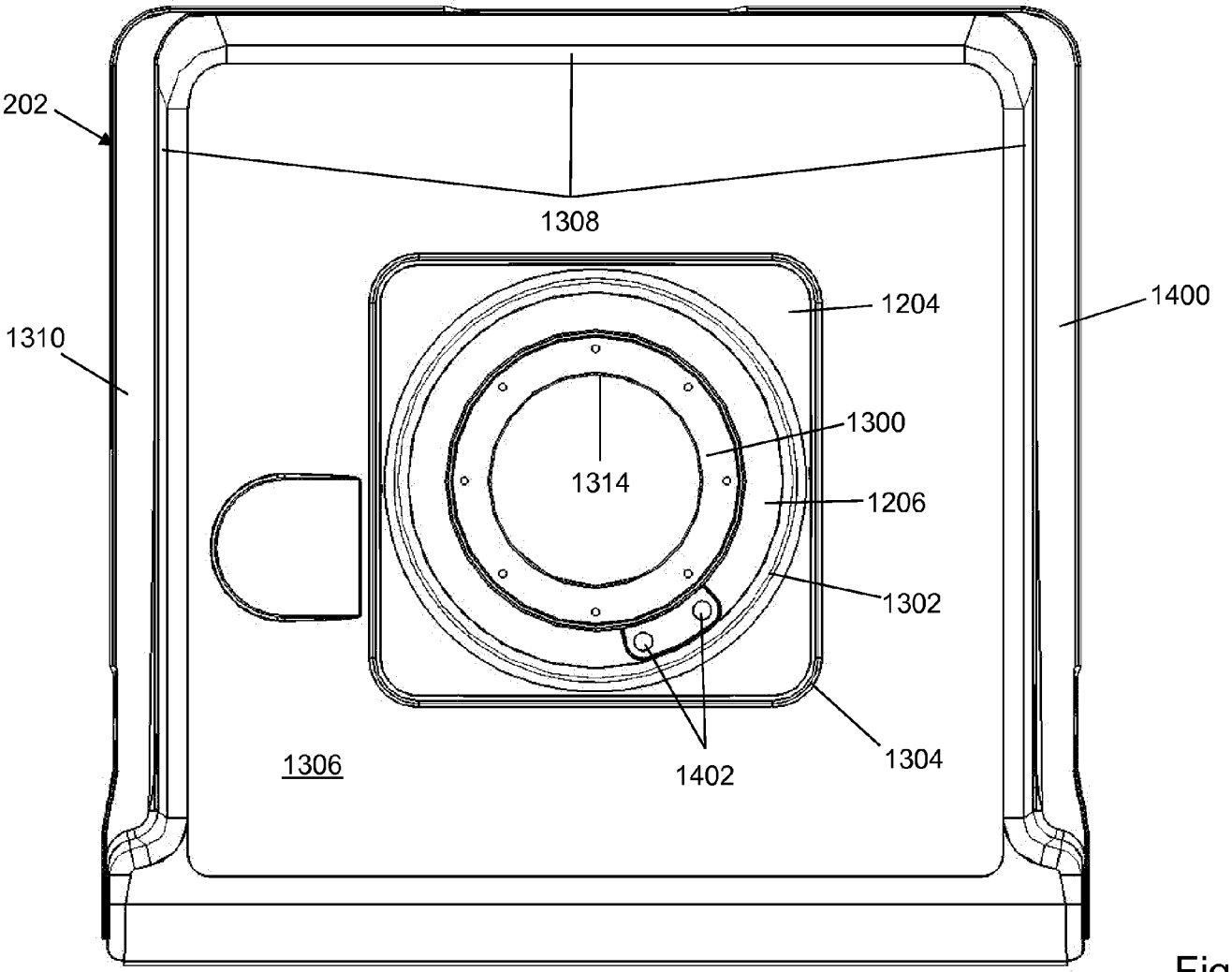
FIG. 14 depicts a top view of the tub bottom wall of FIG. 13 in accordance with an illustrative embodiment.

Referring to FIG. 13, a right side elevation view of tub bottom wall 202 is shown in accordance with an illustrative embodiment. Referring to FIG. 14, a top view of tub bottom wall 202 is shown in accordance with an illustrative embodiment.

Referring to FIGS. 12, 13, and 14, tub bottom wall 202 may include a sump screen ledge 1204, a heater ledge 1206, a sump flange 1300, a heater ledge wall 1302, a screen wall 1304, a tub bottom plate 1306, tub plate sidewalls 1308, a left tub platform 1310, a right tub platform 1400, sump mounting apertures 1312, and a sump aperture edge 1314. Tub bottom plate 1306 slopes downward toward a center of tub bottom wall 202. Screen wall 1304 extends downward from tub bottom plate 1306. Sump screen ledge 1204 extends from a bottom edge of screen wall 1304 towards a center of tub bottom wall 202. Screen wall 1304 and sump screen ledge 1204 form a sump screen depression within tub bottom plate 1306 within which sump screen 206 is mounted. In an illustrative embodiment, there is a flat surface at a bottom of screen wall 1304 that extends inward a short distance, such as ~0.1 inches, and sump screen ledge 1204 extends from this flat surface sloping downward towards the center of tub bottom wall 202. Sump screen 206 may be mounted by positioning on the flat surface. The sump screen depression is sized and shaped to hold sump screen 206.

In an illustrative embodiment, outer rim 502 of sump screen 206 fits within screen wall 1304. Outer rim 502 may be above, below, or flush with a top edge of screen wall 1304. In the illustrative embodiment, outer rim 502 of sump screen 206 and the sump screen depression have a square shape when viewed from above. The sump screen depression and outer rim 502 of sump screen 206 may have alternative shapes such as circular and elliptical as well as other polygonal shapes.

Heater ledge wall 1302 extends downward from sump screen ledge 1204. Heater ledge 1206 extends from a bottom edge of heater ledge wall 1302 towards a center of tub bottom wall 202. Heater ledge wall 1302 and heater ledge 1206 form a heater well within the sump screen depression. The heater well is sized and shaped to accommodate heating element 408 or vice versa. In the illustrative embodiment, heater ledge wall 1302, heater ledge 1206, sump flange 1300, and sump aperture edge 1314 have a circular shape when viewed from above. Heater ledge wall 1302, heater ledge 1206, sump flange 1300, and sump aperture edge 1314 may have alternative shapes such as elliptical as well as other polygonal shapes.

The plurality of brackets 1200 mount heating element 408 above heater ledge 1206. In the illustrative embodiment, heating element 408 is tubular in cross section and forms circular shape when viewed from above similar to the shape of heater ledge 1206. Heating element 408 includes a first connector end 1216 and a second connector end 1218 that mount to electrical connectors as understood by a person of skill in the art. First connector end 1216 and second connector end 1218 are mounted to the electrical connectors through heater element aperture edges 1402. In the illustrative embodiment, heating element 408 surrounds a majority of sump aperture edge 1314. Placing heating element 408 under sump screen 206 allows water to flow through sump screen 206 submerging heating element 408 to provide thorough heating of the liquid without exposing dishware on bottom dishware basket 118 to the higher heat associated with exposed elements and to reduce the probability of localized hot spots.

Sump flange 1300 extends from an edge of heater ledge 1206 generally parallel to heater ledge 1206. A sump sidewall flange 1702 (shown with reference to FIG. 17) mounts to sump flange 1300. Sump rim 1202 mounts to sump sidewall flange 1702 on a side opposite sump flange 1300. Sump flange 1300 includes a sump aperture edge 1314 that defines an opening into an interior of sump 410. Sump flange 1300 further includes sump mounting apertures 1312 formed therethrough. Sump sidewall flange 1702 includes second sump mounting apertures 1808 (shown with reference to FIG. 18) formed therethrough. Sump fasteners 1612 (shown with reference to FIG. 16) inserted through sump mounting apertures 1312 and through second sump mounting apertures 1808 mount sump sidewall flange 1702 to sump flange 1300 and mount sump rim 1202 to sump sidewall flange 1702. Other mounting methods may be used to mount sump 410 to sump flange 1300.

Sump 410 may include a center post conduit 1208, a center post coupler 1210, center post coupler protrusions 1212, and a sump upper bottom wall 1214. Center post conduit 1208 mounts within center post coupler 1210. Center post conduit 1208 may be fluidly connected to a lower spray arm connector 1616 (shown with reference to FIG. 16). Lower spray arm connector 1616 extends through center post aperture edge 1000 of cap 406 and into an interior of lower spray arm 204 between upper plate 500 and lower plate 1100. Lower spray arm connector 1616 mounts to a lower spray arm bearing 1618 (shown with reference to FIG. 16). Lower spray arm bearing 1618 is mounted to a bottom surface of coupler top plate 802. In the illustrative embodiment, Lower spray arm bearing 1618 has a squared "C" shape extending outward from lower spray arm connector 1616. Center post coupler 1210 mounts within spray arm coupler 404 that mounts within filter 402.

Center post coupler protrusions 1212 extend horizontally from center post coupler 1210 away from center post conduit 1208. Center post coupler protrusions 1212 are configured to extend through vertical channel 812 and horizontal channel 814 of each coupling aperture edge of the coupling aperture edges 810. Spray arm coupler 404 is rotated to align vertical channel 812 of each coupling aperture edge with respective center post coupler protrusions 1212. Spray arm coupler 404 is moved downward until the center post coupler protrusions 1212 contact a top of horizontal channel 814 of a respective coupling aperture edge. Spray arm coupler 404 is rotated to move the horizontal channel 814 along the respective center post coupler protrusions 1212. Spray arm coupler 404 thereby removably mounts lower spray arm 204 to center post coupler 1210.

The plurality of posts 516 mount to coupler top plate 802, for example, by abutting a bottom surface of coupler top plate 802 and/or a bottom surface of cap 406. Shelf 708 mounts filter 402 to sump screen 206, for example, by abutting a top surface of ledge 602. To remove filter 402, lower spray arm 204, spray arm coupler 404, and cap 406 from dishwasher basin 300, cap 406 is rotated to release center post coupler protrusions 1212 from the horizontal channel 814 of the respective center post coupler protrusions 1212. Once released from the horizontal channel 814, cap 406 is lifted upward to release center post coupler protrusions 1212 from the vertical channel 812 of the respective center post coupler protrusions 1212. Spray arm coupler 404 thereby removably mounts filter 402 and cap 406 to center post coupler 1210. Sump screen 206 can be lifted from tub bottom wall 202, for example, by grasping sump aperture edge 1314 and lifting. An interior of sump 410 can be accessed after removal of filtration system 400, lower spray arm 204, spray arm coupler 404, and cap 406 from dishwasher basin 300.

Tub plate sidewalls 1308 extend up from tub bottom plate 1306. A left tub platform 1310 extends horizontally from a left side of the tub plate sidewalls 1308. A right tub platform 1400 extends horizontally from a right side of the tub plate sidewalls 1308. Left tub platform 1310 and right tub platform 1400 support bottom dishware basket 118.

Figure 15:
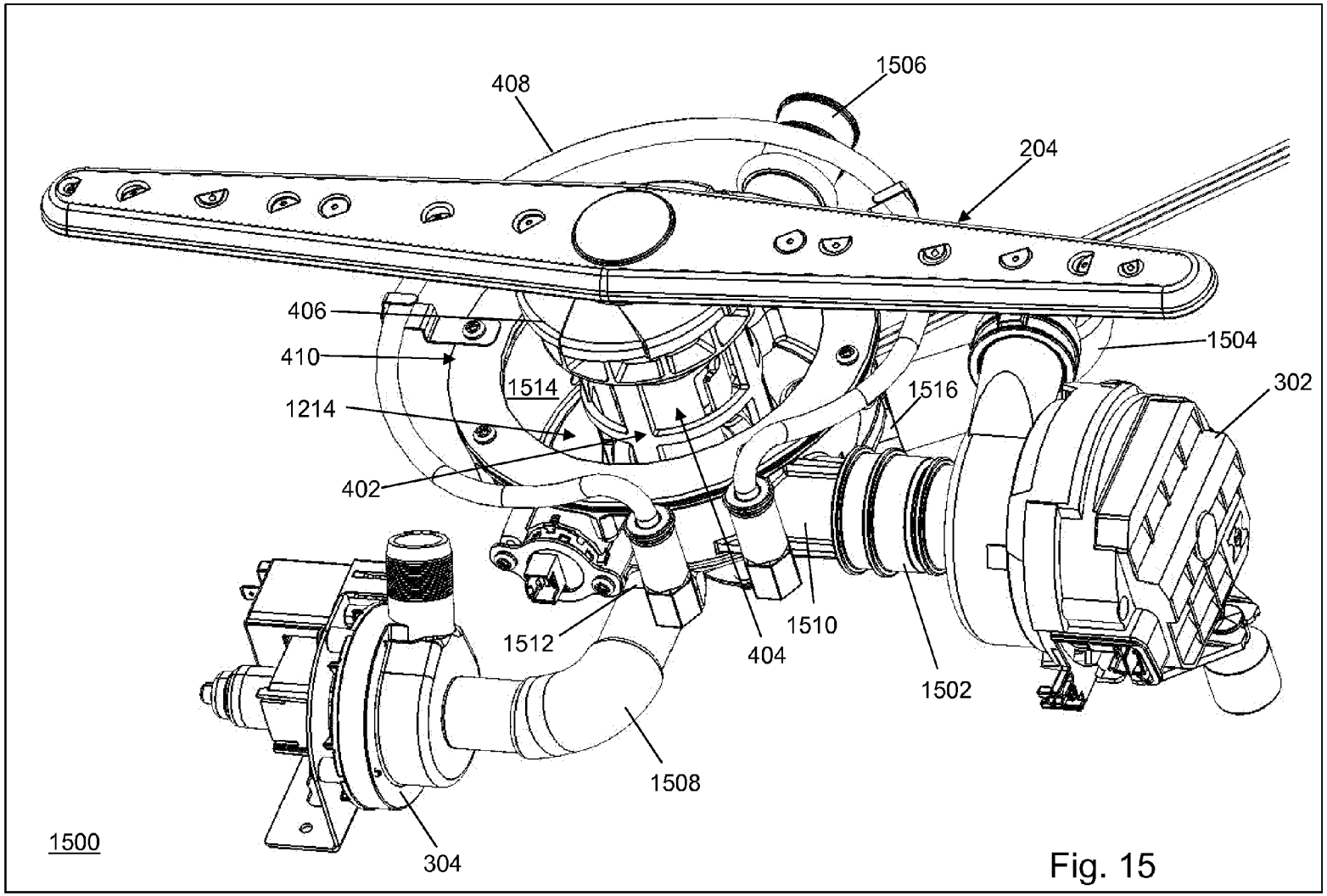
FIG. 15 depicts a top, front perspective view of a water processing system of the dishwasher of FIG. 1 in accordance with an illustrative embodiment.

Referring to FIG. 15, a top, front perspective view of a water processing system 1500 of dishwasher 100 is shown in accordance with an illustrative embodiment. In the illustrative embodiment, water processing system 1500 may include lower spray arm 204, filtration system 400, spray arm coupler 404, heating element 408, sump 410, wash pump 302, drain pump 304, a wash pump input conduit 1502, a wash pump output conduit 1504, an upper spray arm conduit 1506, and a drain conduit 1508. Sump 410 may include a wash pump input nozzle 1510, a drain pump input nozzle 1512, a sump sidewall 1514, and a spray arm nozzle 1516.

Figure 16:
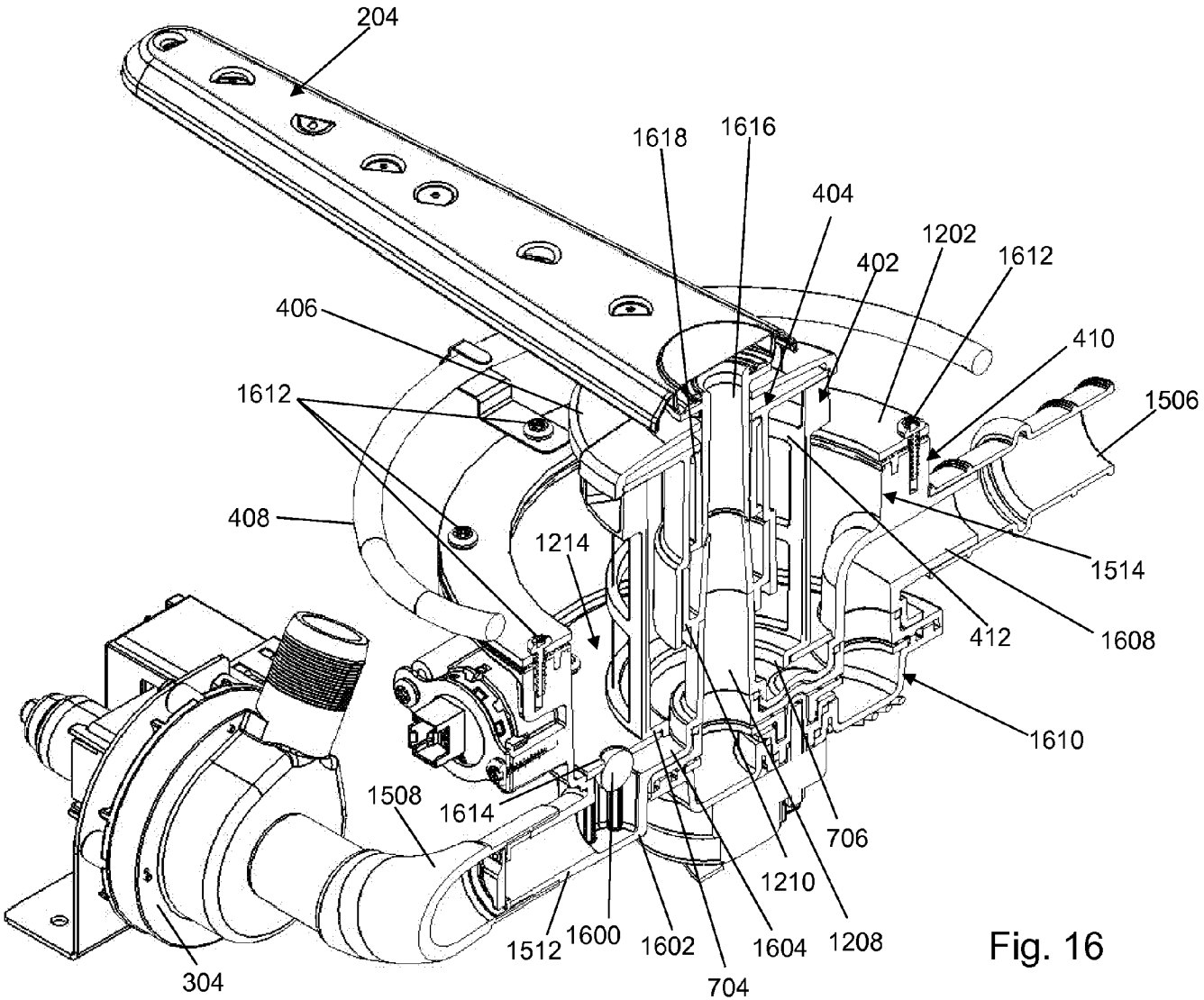
FIG. 16 depicts a right side elevation view of the water processing system of FIG. 15 in accordance with an illustrative embodiment.

Referring to FIG. 16, a right side elevation view of water processing system 1500 is shown in accordance with an illustrative embodiment. Sump 410 further may include a ball 1600, a drain conduit elbow 1602, a sump bottom wall 1604, an upper spray arm nozzle 1608, a spray arm intake valve 1610, and sump fasteners 1612. Spray arm nozzle 1516 is mounted to spray arm intake valve 1610.

Referring to FIGS. 15 and 16, wash pump input nozzle 1510 and upper spray arm nozzle 1608 are mounted through sump sidewall 1514. Wash pump input nozzle 1510 mounts to wash pump input conduit 1502 that mounts to wash pump 302. Liquid from sump 410 filtered through the sump screen mesh and the filter mesh is provided to wash pump 302 through wash pump input nozzle 1510 and wash pump input conduit 1502.

Drain conduit elbow 1602 is mounted through sump bottom wall 1604. Drain pump input nozzle 1512 mounts to drain conduit elbow 1602. Drain conduit 1508 mounts between drain pump input nozzle 1512 and drain pump 304. Liquid from sump 410 is provided to drain pump 304 through drain conduit elbow 1602, drain pump input nozzle 1512, and drain conduit 1508. During a wash cycle of dishwasher 100, liquid may be provided to drain pump 304 from an interior of filter 402 through the bottom aperture edge of filter 402. During the wash cycle, ball 1600 floats up to block a ball aperture edge 1614 formed through sump upper bottom wall 1214 to prevent the flow of liquid through ball aperture edge 1614. During a drain cycle of dishwasher 100, ball 1600 drops down towards a bottom of drain conduit elbow 1602 and unblocks ball aperture edge 1614 to allow the liquid to flow through ball aperture edge 1614 and towards drain pump 304. During the drain cycle, liquid is provided to drain pump 304 from the interior of filter 402 through the bottom aperture edge of filter 402 and through ball aperture edge 1614. Ball 1600 is sized and shaped to block ball aperture edge 1614 while allowing the flow of liquid through drain conduit elbow 1602.

Sump sidewall 1514 extends up from sump bottom wall 1604. Upper sump bottom wall 1214 is mounted between sides of sump sidewall 1514 and above sump bottom wall 1604 thereby forming a cavity below upper sump bottom wall 1214. Filter bottom wall 704 mounts to upper sump bottom wall 1214 by resting on a top surface of upper sump bottom wall 1214. Filter flange 706 extends downward through a second filter aperture edge 2000 (shown with reference to FIG. 20) formed in upper sump bottom wall 1214. Center post conduit 1208 extends up within second filter aperture edge 2000 and is encircled by filter flange 706. The bottom aperture edge that surrounds the opening mounted through filter bottom wall 704 allows material and liquid to flow into the cavity formed between upper sump bottom wall 1214 and sump bottom wall 1604 and into drain conduit elbow 1602.

Wash pump output conduit 1504 mounts to wash pump 302. Spray arm nozzle 1516 mounts to wash pump output conduit 1504 to receive liquid from wash pump 302. Spray arm nozzle 1516 is mounted to provide the liquid from wash pump 302 to upper spray arm nozzle 1608 and to center post conduit 1208. Upper spray arm conduit 1506 mounts between upper spray arm nozzle 1608 and the middle spray arm and/or the upper spray arm to provide liquid thereto from wash pump 302.

Figure 17:
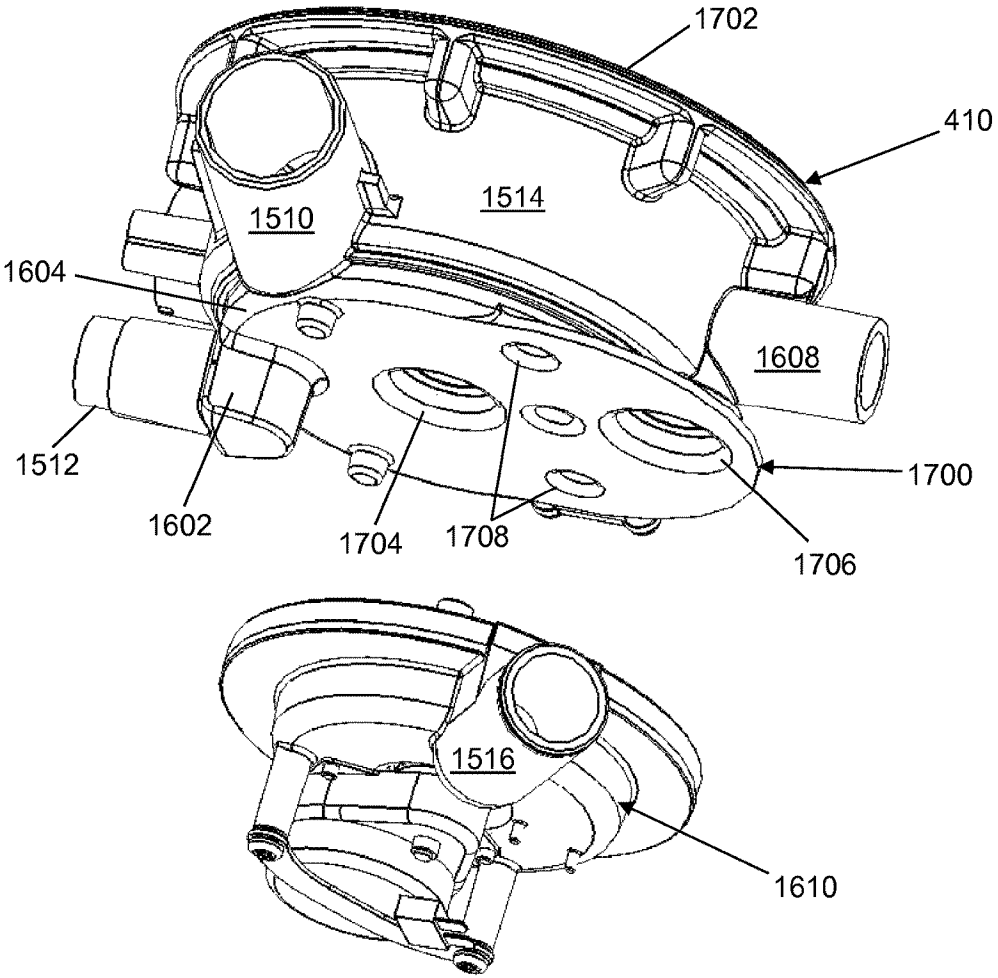
FIG. 17 depicts a right, bottom perspective, exploded view of a sump of the dishwasher of FIG. 1 in accordance with an illustrative embodiment.

Referring to FIG. 17, a right, bottom perspective, exploded view of sump 410 is shown in accordance with an illustrative embodiment. Sump 410 further may include a wash pump input plate 1700 and sump sidewall flange 1702. Wash pump input plate 1700 may include a center post input aperture edge 1704, an upper spray arm input aperture edge 1706, and input plate mounting aperture edges 1708. Drain conduit elbow 1602 extends from wash pump input plate 1700.

Figure 18:
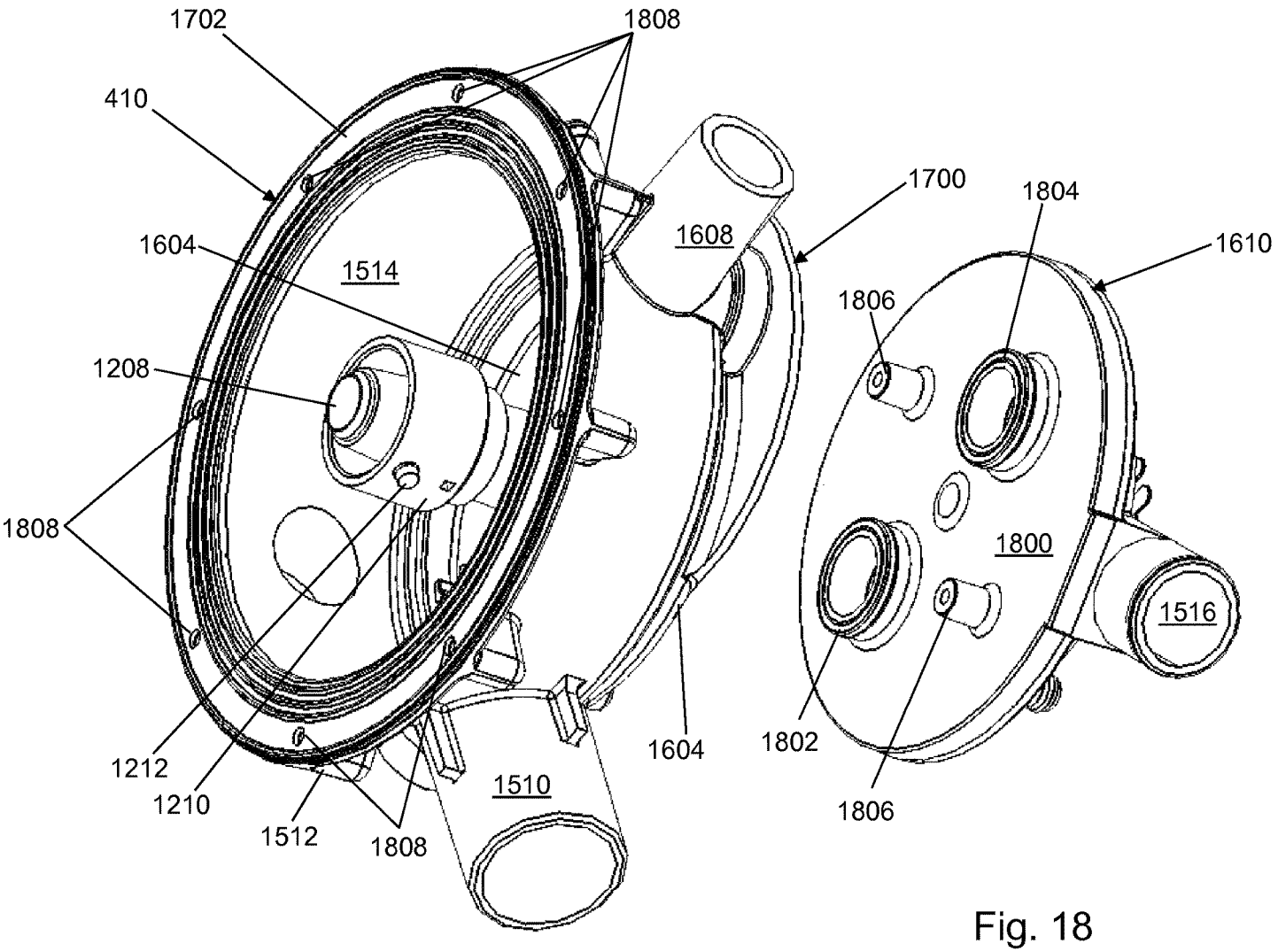
FIG. 18 depicts a top, right perspective, exploded view of the sump of the dishwasher of FIG. 1 in accordance with an illustrative embodiment.

Referring to FIG. 18, a top, right perspective, exploded view of sump 410 is shown in accordance with an illustrative embodiment. Spray arm intake valve 1610 further may include a top valve plate 1800, a center post nozzle 1802, an upper spray arm nozzle 1804, and input plate fasteners 1806. Spray arm intake valve 1610 controls a flow of liquid between lower spray arm 204 and the middle and upper spray arms.

Center post nozzle 1802 mounts within center post input aperture edge 1704 to provide liquid from spray arm nozzle 1516 to center post conduit 1208 and thereby to lower spray arm 204. Upper spray arm nozzle 1804 mounts within upper spray arm input aperture edge 1706 to provide liquid from spray arm nozzle 1516 to upper spray arm nozzle 1608. Input plate fasteners 1806 mount within input plate mounting aperture edges 1708 to mount spray arm intake valve 1610 to wash pump input plate 1700.

Figure 19:
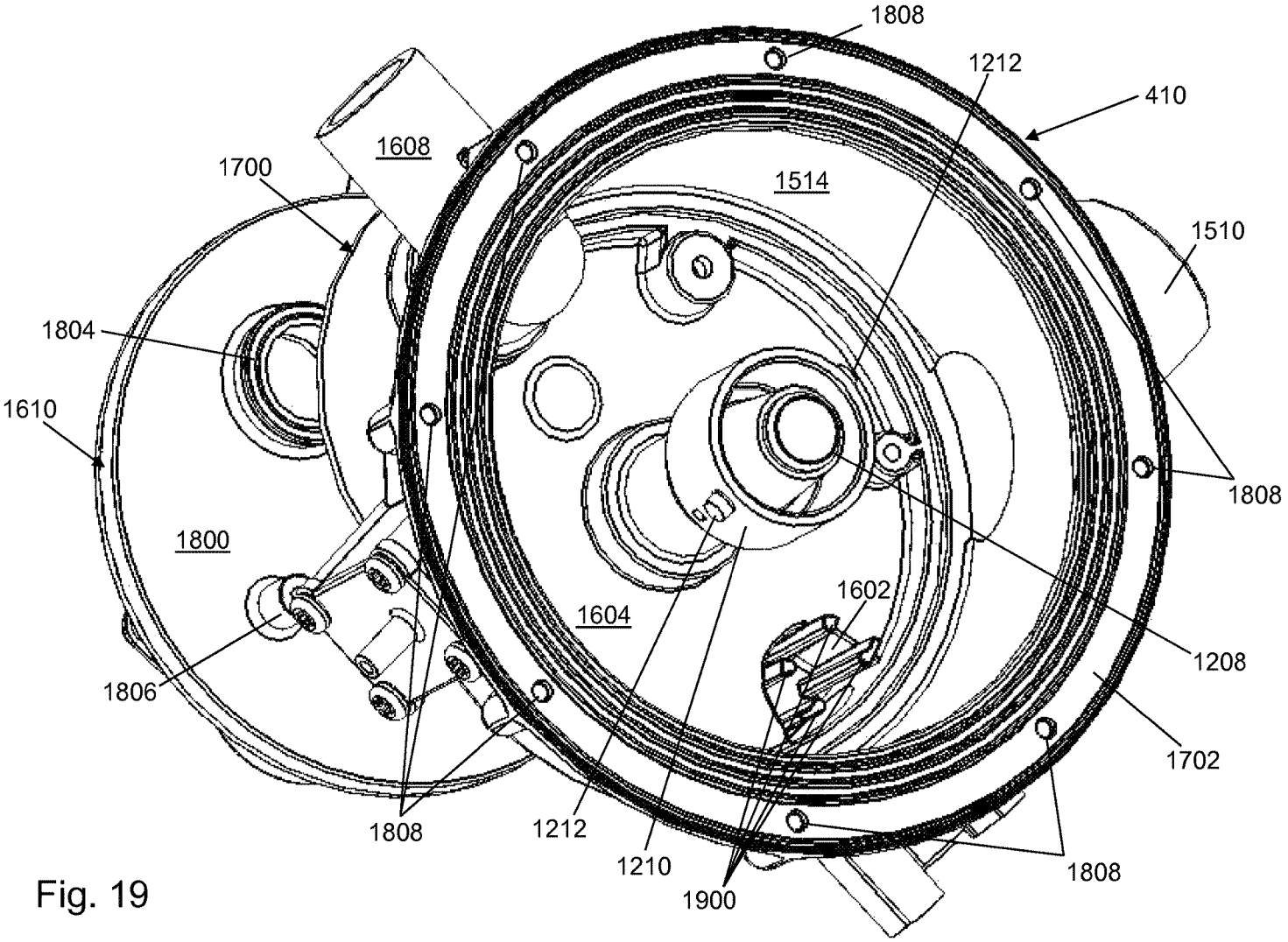
FIG. 19 depicts a top, left perspective, exploded view of the sump of the dishwasher of FIG. 1 in accordance with an illustrative embodiment.

Referring to FIG. 19, a top, left perspective, exploded view of sump 410 is shown in accordance with an illustrative embodiment. Sump 410 further may include ball chute prongs 1900. Ball chute prongs 1900 are mounted within drain conduit elbow 1602 to guide the up and down movement of ball 1600. Ball 1600 floats up and down under control of suction from wash pump 302 and/or from drain pump 304.

Figure 20:
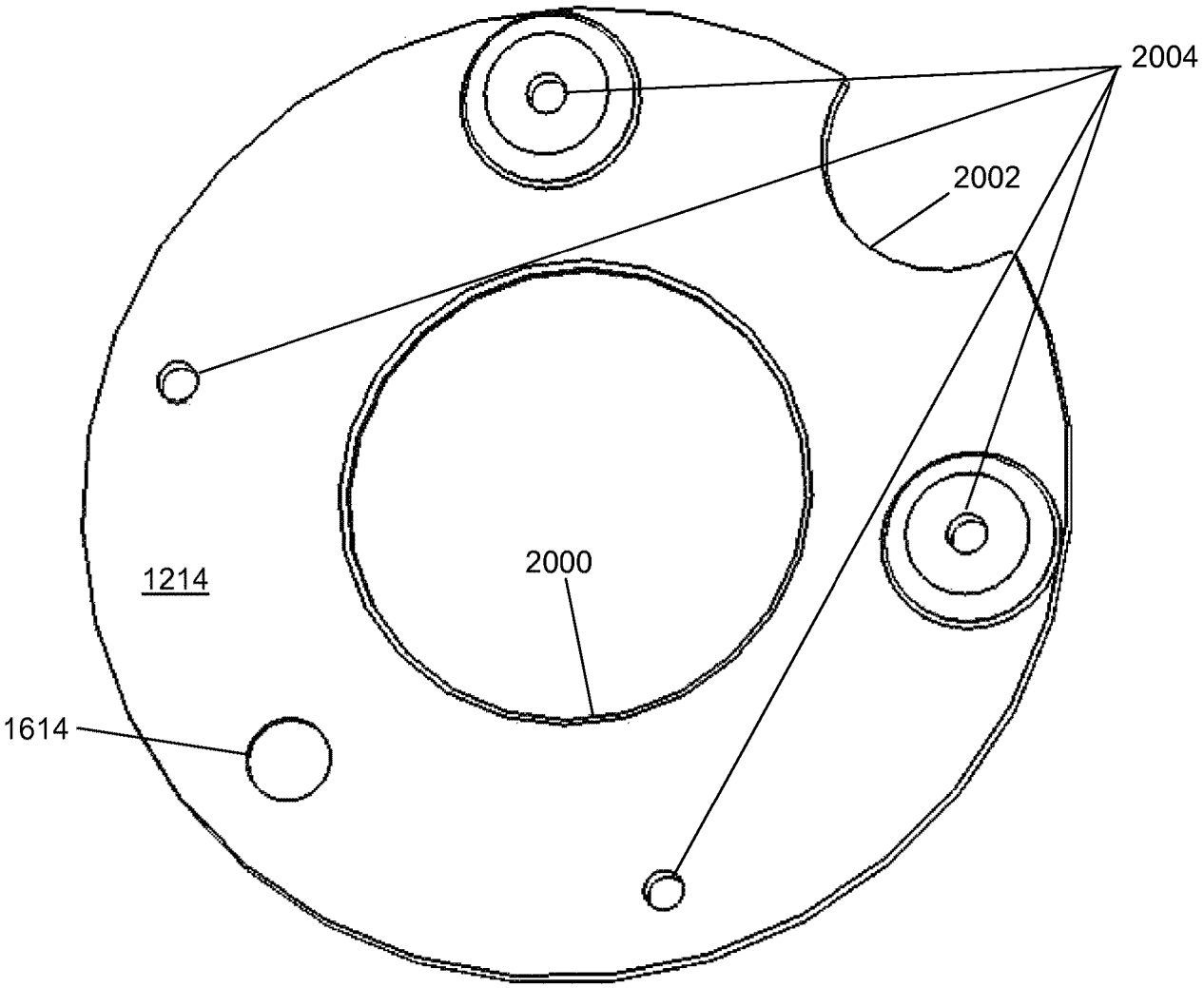
FIG. 20 depicts a top perspective view of a sump upper bottom wall of the sump of FIG. 17 in accordance with an illustrative embodiment.

Referring to FIG. 20, a top perspective view of sump upper bottom wall 1214 is shown in accordance with an illustrative embodiment. Sump upper bottom wall 1214 may include filter aperture edge 2000, ball aperture edge 1614, an upper spray arm nozzle aperture edge 2002, and upper sump bottom wall mounting apertures 2004. Upper spray arm nozzle aperture edge 2002 is formed in sump upper bottom wall 1214 to accommodate upper spray arm nozzle 1608. Upper sump bottom wall mounting apertures 2004 are mounted through sump upper bottom wall 1214. A fastener is inserted in each of upper sump bottom wall mounting apertures 2004 to mount sump upper bottom wall 1214 above sump bottom wall 1604.

Sump upper bottom wall 1214 divides sump 410 into two sections. Wash pump 302 takes its suction from an upper portion of sump 410 above sump upper bottom wall 1214. Drain pump 304 takes its suction from a lower portion of sump 410 below sump upper bottom wall 1214. Ball 1600 floats up during the wash cycle isolating the upper and lower portions of sump 410. Debris is trapped in the interior of filter 402 and in the lower portion of sump 410 so that the debris does not enter into the wash water during the wash cycle of operation of dishwasher 100. During the drain cycle, ball 1600 drops allowing a more complete draining of sump 410. Through continuous operation in the wash cycle, fine particles are trapped in the interior of filter 402 and in the lower portion of sump 410 underneath sump upper bottom wall 1214. These particles are drained out of the system during the drain cycle and subsequent fills utilize successively cleaner water for the wash cycle.

The word "illustrative" is used herein to mean serving as an example, instance, or illustration. Any aspect or design described herein as "illustrative" is not necessarily to be construed as preferred or advantageous over other aspects or designs. Further, for the purposes of this disclosure and unless otherwise specified, "a" or "an" means "one or more". Still further, in the detailed description, the use of "and" or "or" is intended to include "and/or" unless specifically indicated otherwise.

The foregoing description of illustrative embodiments has been presented for purposes of illustration and of description. It is not intended to be exhaustive or to limit the subject matter to the precise form disclosed. Modifications and variations are possible in light of the above teachings or may be acquired from practice of the disclosed subject matter. The embodiments were chosen and described in order to explain the principles of the disclosed subject matter and as practical applications of the disclosed subject matter to enable one skilled in the art to utilize the disclosed subject matter in various embodiments and with various modifications as suited to the particular use contemplated.

What is claimed is:

1. A liquid filtration system comprising:

a sump screen configured to cover a majority of a sump mounted to a tub bottom wall, the sump screen comprising a plate, wherein a majority of the plate comprises a sump mesh, the sump mesh having a sump mesh size of less than approximately 0.1 inches; and a filter aperture edge forming an aperture through a center of the plate;

a filter configured to mount to the filter aperture edge, the filter comprising a cylindrical sidewall, wherein at least a portion of the cylindrical sidewall comprises a filter mesh having a filter mesh size of less than approximately 0.1 inches, wherein the filter aperture edge is configured to accept the cylindrical sidewall therethrough and the cylindrical sidewall is sized to accept a lower spray arm connector within the cylindrical sidewall, wherein the cylindrical sidewall extends down relative to the plate; and a plurality of posts mounted to extend up from the cylindrical sidewall, wherein at least a portion of each post of the plurality of posts extends above the filter aperture edge when the filter is mounted to the filter aperture edge; and a cap comprising a center post aperture edge forming an aperture therethrough, wherein the center post aperture edge is shaped and sized to accept the lower spray arm connector, wherein the cap is mounted above the plurality of posts, wherein the plurality of posts and the cap form one or more conduits sized to allow material that cannot pass through the sump mesh to flow through the one or more conduits to collect the material within the filter mesh of the cylindrical sidewall.

2. The liquid filtration system of claim 1, wherein the sump screen further comprises an outer rim mounted to an exterior edge of the plate, wherein at least a portion of the plate slopes downward toward the filter aperture edge.

3. The liquid filtration system of claim 1, wherein the sump screen further comprises a wall extending downward from an inner rim of the plate and a ledge extending away from the wall and toward the center of the plate, wherein the ledge is the filter aperture edge.

4. The liquid filtration system of claim 3, wherein the filter further comprises a shelf mounted on a top edge of the sidewall, wherein the plurality of posts are mounted to the shelf, and further wherein the shelf is mounted to the ledge when the filter is mounted to the filter aperture edge.

5. The liquid filtration system of claim 1, wherein the plurality of posts are mounted to a top edge of the sidewall, wherein the top edge of the sidewall forms a top aperture edge and a bottom edge of the sidewall forms a bottom aperture edge opposite the top aperture edge, wherein the filter mesh is mounted across at least a portion of the bottom aperture edge.

6. The liquid filtration system of claim 1, wherein the conduit is sized to block material having the dimension greater than approximately one inch.

7. The liquid filtration system of claim 1, wherein the conduit is sized to block material having the dimension greater than approximately 0.35 inches.

8. The liquid filtration system of claim 1, wherein the sump mesh size is less than approximately 0.03 inches.

9. The liquid filtration system of claim 8, wherein the filter mesh size is less than approximately 0.008 inches.

10. A liquid processing system comprising:

a center post conduit configured to mount to a liquid source;

a spray arm configured to mount to the center post conduit and configured to receive liquid from the center post conduit, the spray arm comprising a hole through which the liquid received from the center post conduit is sprayed; and a liquid filtration system comprising a sump screen configured to cover a majority of a sump mounted to a tub bottom wall, the sump screen comprising a plate, wherein a majority of the plate comprises a sump mesh, the sump mesh having a sump mesh size of less than approximately 0.1 inches; and a filter aperture edge forming an aperture through a center of the plate;

a filter configured to mount to the filter aperture edge, the filter comprising a cylindrical sidewall, wherein at least a portion of the cylindrical sidewall comprises a filter mesh having a filter mesh size of less than approximately 0.1 inches, wherein the filter aperture edge is configured to accept the cylindrical sidewall therethrough and the cylindrical sidewall is sized to accept the center post conduit within the cylindrical sidewall, wherein the cylindrical sidewall extends down relative to the plate; and a plurality of posts mounted to extend up from a top edge of the cylindrical sidewall, wherein the top edge of the cylindrical sidewall forms a top aperture edge and a bottom edge of the cylindrical sidewall forms a bottom aperture edge opposite the top aperture edge, wherein at least a portion of each post of the plurality of posts extends above the filter aperture edge when the filter is mounted to the filter aperture edge; and a cap comprising a center post aperture edge forming an aperture therethrough, wherein the center post aperture edge is shaped and sized to accept the center post conduit, wherein the cap is mounted above the plurality of posts, wherein the plurality of posts and the cap form one or more conduits sized to allow material that cannot pass through the sump mesh to flow through the one or more conduits to collect the material within the filter mesh of the cylindrical sidewall;

wherein the center post conduit is configured to extend through the bottom aperture edge, the top aperture edge, and the center post aperture edge of the cap, and further wherein the spray arm is configured to mount above the cap on a side opposite the plurality of posts.

11. The liquid processing system of claim 10, wherein the sump screen further comprises an outer rim mounted to an exterior edge of the plate, wherein at least a portion of the plate slopes downward toward the filter aperture edge.

12. The liquid processing system of claim 10, wherein the sump screen further comprises a wall extending downward from an inner rim of the plate and a ledge extending away from the wall and toward the center of the plate, wherein the ledge is the filter aperture edge, and further wherein the filter further comprises a shelf mounted on a top edge of the cylindrical sidewall, wherein the plurality of posts are mounted to the shelf, and further wherein the shelf is mounted to the ledge when the filter is mounted to the filter aperture edge.

13. The liquid processing system of claim 10, further comprising a coupler configured to mount to the cap on a side opposite the spray arm, the coupler comprising a coupler sidewall and a coupling aperture edge mounted through the coupler sidewall, wherein a top edge of the coupler sidewall forms a coupler top aperture edge and a bottom edge of the coupler sidewall forms a coupler bottom aperture edge opposite the coupler top aperture edge, wherein the center post conduit is configured to extend through the coupler bottom aperture edge and the coupler top aperture edge, and further wherein the coupler is configured to extend through the bottom aperture edge and the top aperture edge.

14. The liquid processing system of claim 13, wherein the center post conduit comprises a protrusion configured to extend through an opening formed by the coupling aperture edge.

15. The liquid processing system of claim 14, wherein the coupling aperture edge forms a vertical channel that extends up from the coupler bottom aperture edge and a horizontal channel that extends from the vertical channel.

16. The liquid processing system of claim 10, further comprising the tub bottom wall, wherein the tub bottom wall comprises a sump screen depression configured to hold the sump screen, a well mounted within the sump screen depression, and a sump aperture edge mounted within the well, wherein the filter is configured to mount within the sump aperture edge.

17. The liquid processing system of claim 16, wherein the well comprises a wall extending downward from an aperture edge mounted in the sump screen depression, and a ledge extending away from the wall and toward a center of the sump screen depression, wherein a heating element is mounted above the ledge.

18. The liquid processing system of claim 17, further comprising the heating element, wherein the heating element surrounds a majority of the sump aperture edge.

19. The liquid processing system of claim 16, further comprising a sump comprising a bottom wall, a sump sidewall mounted to extend up from the bottom wall, and a rim mounted to extend outward from the sump sidewall at an end opposite the bottom wall, wherein the rim is configured to mount to the sump aperture edge such that the bottom wall is below the sump aperture edge.

20. The liquid processing system of claim 19, wherein the sump further comprises an upper bottom wall mounted within the sump sidewall, above the bottom wall, and below the rim, wherein the upper bottom wall comprises a second filter aperture edge mounted through the upper bottom wall, wherein the bottom edge of the cylindrical sidewall of the filter is configured to mount to the second filter aperture edge.

21. The liquid processing system of claim 20, wherein the upper bottom wall further comprises a ball aperture edge mounted through the upper bottom wall.

22. The liquid processing system of claim 21, further comprising a ball mounted within a drain conduit elbow mounted to the sump, wherein the ball is configured to fill a space within the ball aperture edge.

23. The liquid processing system of claim 22, wherein the drain conduit elbow is mounted below the upper bottom wall and configured to receive liquid through the second filter aperture edge.

24. The liquid processing system of claim 23, further comprising a wash pump input nozzle configured to mount to the sump above the upper bottom wall and configured to receive liquid flowing through the filter mesh of the cylindrical sidewall of the filter.

25. The liquid processing system of claim 24, wherein the wash pump input nozzle is further configured to receive liquid flowing through the sump mesh of the plate.

26. The liquid processing system of claim 25, wherein the wash pump input nozzle is not configured to receive liquid flowing through the second filter aperture edge.

27. The liquid processing system of claim 24, wherein the wash pump input nozzle is configured to mount to a wash pump, wherein the wash pump is the liquid source.

28. The liquid processing system of claim 27, further comprising a spray arm nozzle configured to mount to the center post conduit at a first end and to mount to the wash pump at a second end to mount the center post conduit to the wash pump to receive the liquid.

29. The liquid processing system of claim 22, wherein the drain conduit elbow is configured to receive liquid flowing through the ball aperture edge when the ball does not abut the ball aperture edge.

30. A washer comprising:

a body;

a tub bottom wall mounted within the body;

a door;

a hinge pivotally mounting the door to the body;

a fluid supply system mounted to the body and comprising a wash pump;

a first conduit mounted to the wash pump to receive liquid from the wash pump;

a second conduit mounted to the wash pump to receive liquid from a wash pump input nozzle of a sump; and a center post conduit configured to mount to the first conduit;

a spray arm configured to mount to the center post conduit and configured to receive the liquid from the wash pump, the spray arm comprising a hole through which the liquid received from the wash pump is sprayed; and a liquid filtration system comprising a sump screen configured to cover a majority of a sump mounted to the tub bottom wall, the sump screen comprising a plate, wherein a majority of the plate comprises a sump mesh, the sump mesh having a sump mesh size of less than approximately 0.1 inches; and a filter aperture edge forming an aperture through a center of the plate;

a filter configured to mount to the filter aperture edge, the filter comprising a cylindrical sidewall, wherein at least a portion of the cylindrical sidewall comprises a filter mesh having a filter mesh size of less than approximately 0.1 inches, wherein the filter aperture edge is configured to accept the cylindrical sidewall therethrough and the cylindrical sidewall is sized to accept the center post conduit within the cylindrical sidewall, wherein the cylindrical sidewall extends down relative to the plate; and a plurality of posts mounted to extend up from a top edge of the cylindrical sidewall, wherein the top edge of the cylindrical sidewall forms a top aperture edge and a bottom edge of the cylindrical sidewall forms a bottom aperture edge opposite the top aperture edge, wherein at least a portion of each post of the plurality of posts extends above the filter aperture edge when the filter is mounted to the filter aperture edge; and a cap comprising a center post aperture edge forming an aperture therethrough, wherein the center post aperture edge is shaped and sized to accept the center post conduit, wherein the cap is mounted above the plurality of posts, wherein the plurality of posts and the cap form one or more conduits sized to allow material that cannot pass through the sump mesh to flow through the one or more conduits to collect the material within the filter mesh of the cylindrical sidewall;

wherein the center post conduit is configured to extend through the bottom aperture edge, the top aperture edge, and the center post aperture edge of the cap, and further wherein the spray arm is configured to mount above the cap on a side opposite the plurality of posts.

* * * * *